US008191520B2

(12) United States Patent
Kidooka et al.

(10) Patent No.: US 8,191,520 B2
(45) Date of Patent: Jun. 5, 2012

(54) VARIABLE VALVE OPERATING APPARATUS FOR INTERNAL COMBUSTION ENGINE

(75) Inventors: Akio Kidooka, Ashigarakami-gun (JP); Toshiyuki Yano, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 245 days.

(21) Appl. No.: 12/676,830

(22) PCT Filed: May 29, 2009

(86) PCT No.: PCT/JP2009/059835

§ 371 (c)(1), (2), (4) Date: Mar. 5, 2010

(87) PCT Pub. No.: WO2010/137159

PCT Pub. Date: Dec. 2, 2010

(65) Prior Publication Data

US 2011/0126786 A1 Jun. 2, 2011

(51) Int. Cl.
*F01L 1/34* (2006.01)

(52) U.S. Cl. ..... 123/90.16; 123/90.15

(58) Field of Classification Search ..... 123/90.15, 123/90.16, 90.18

See application file for complete search history.

(56) References Cited

U.S. PATENT DOCUMENTS 6,915,768 B2 * 7/2005 Ohsawa ..... 123/90.16

FOREIGN PATENT DOCUMENTS

| | | | |
|---|---|---|---|
| JP | 2-11812 | A | 1/1990 |
| JP | 2-95710 | A | 4/1990 |
| JP | 7-23558 | Y2 | 5/1995 |
| JP | 11-235000 | A | 8/1999 |
| JP | 2004-124794 | A | 4/2004 |
| JP | 2005-042717 | A | 2/2005 |
| JP | 2006-242013 | A | 9/2006 |
| JP | 2006-242018 | A | 9/2006 |
| JP | 2006-520869 | A | 9/2006 |
| JP | 2006-307712 | A | 11/2006 |
| JP | 2008-196462 | A | 8/2008 |

* cited by examiner

*Primary Examiner* — Zelalem Eshete
(74) *Attorney, Agent, or Firm* — Kenyon & Kenyon LLP

(57) ABSTRACT

Provided is a variable valve operating apparatus for an internal combustion engine, which can favorably improve the mounting environment of an actuator in the aspect of achieving the improvement of coolability and the reduction of stress. The apparatus includes a guide rail which is provided in the outer peripheral surface of a cylindrical part respectively fixed to a camshaft; a projection part which is disposed so as to be engageable and disengageable with the guide rail; and an actuator which is disposed so as to oppose the cylindrical part and can protrude the projection part toward the guide rail. At least a part of the actuator is disposed so as to fit in a oval-shaped region which is virtually obtained by linking a base circle of a main cam and a base circle of a main cam seen from the axial direction of the camshaft in a state in which the projection part is not protruded toward the guide rail.

13 Claims, 12 Drawing Sheets

VARIABLE VALVE OPERATING APPARATUS FOR INTERNAL COMBUSTION ENGINE

This is a 371 national phase application of PCT/JP2009/059835 filed 29 May 2009, the contents of which are incorporated herein by reference.

TECHNICAL FIELD

The present invention relates to a variable valve operating apparatus for an internal combustion engine.

BACKGROUND ART

Previously, for example, Patent Document 1 discloses a valve operating mechanism of an internal combustion engine in which a cam carrier provided with two kinds of cams is provided for each cylinder, and the cam carrier is moved in the axial direction with respect to a cam main-shaft which is rotated so that valve drive cams for each cylinder are switched. To be more specific, in this conventional valve operating mechanism, guide grooves which are formed into a helical shape are provided respectively in both ends of the outer peripheral surface of each cam carrier. Moreover, an electric actuator, which drives a drive pin to be inserted into or removed from the guide groove, is provided for each guide groove.

According to the above-described conventional valve operating mechanism, the cam carrier can be moved with respect to the axial direction by inserting the drive pin to the guide groove, and thus the lift amounts of valves can be changed by switching the valve drive cams of each cylinder. Moreover, in the above-described conventional valve operating mechanism, the above-described electric actuator is disposed outside a cylinder head.

Including the above-referenced document, the applicant is aware of the following documents as a related art of the present invention.

[Patent Document 1] National Publication of International Patent Application No. 2006-520869

[Patent Document 2] Japanese Patent No. 2663556

[Patent Document 3] Japanese Laid-open Patent Application Publication No. Hei 11-235000

[Patent Document 4] Japanese Laid-open Patent Application Publication No. 2004-124794

[Patent Document 5] Japanese Laid-open Patent Application Publication No. 2008-196462

[Patent Document 6] Japanese Utility Model Publication No. Hei 07-23558

DISCLOSURE OF THE INVENTION

Problem to be Solved by the Invention

In a variable valve operating apparatus which changes valve-opening characteristics of a valve through the use of: a guide rail which is provided in the outer peripheral surface of a cylindrical part that is attached fixedly or movably in axial direction to a camshaft; a projection part which is engageable and disengageable with the guide rail; and an actuator which can protrude the projection part toward the guide rail, if the actuator for switching between the valve-opening characteristics of the valve is provided in the outside of an internal combustion engine as in the case of the technique according to the above described Patent Document 1, it becomes difficult to effectively perform the cooling of the actuator. On the other hand, it is desirable that the mounting position of the actuator is arranged such that the actuator is not subjected to a large stress when the actuator protrudes the projection part toward the guide rail.

The present invention has been made to solve the problem as described above, and has its object to provide a variable valve operating apparatus for an internal combustion engine which can favorably improve the mounting environment of the actuator in the aspect of achieving the improvement of coolability and the reduction of stress.

Means for Solving the Problem

A first aspect of the present invention is a variable valve operating apparatus for an internal combustion engine, the apparatus comprising:

a first camshaft to which a first cam for driving a first valve in a cylinder of the internal combustion engine is attached fixedly or movably in an axial direction;

a second camshaft to which a second cam for driving a second valve disposed in the same cylinder as that of the first valve is attached fixedly or movably in an axial direction;

a guide rail which is provided in an outer peripheral surface of a cylindrical part which is attached fixedly or movably in the axial direction respectively to the first and second camshafts;

a projection part which is disposed so as to be engageable and disengageable with the guide rail; and an actuator which is disposed so as to oppose the cylindrical part, and is able to protrude the projection part toward the guide rail, wherein valve-opening characteristics of the first valve and the second valve are changed as a relative displacement between the projection part and the cylindrical part takes place at a time of engagement between the projection part and the guide rail, and wherein in a state in which the projection part is not protruded toward the guide rail, at least a part of the actuator is disposed so as to fit in an oval-shaped region seen from the axial direction of the first and second camshafts, the oval-shaped region being virtually obtained by linking: a circle of the larger of a circle diameter of the cylindrical part and a base circle diameter of the first cam which are attached to the first camshaft; and a circle of the larger of a circle diameter of the cylindrical part and a base circle diameter of the second cam which are attached to the second cam.

A second aspect of the present invention is the variable valve operating apparatus for the internal combustion engine according to the first aspect of the present invention, further comprising:

a variable mechanism disposed at least in one of between the first cam and the first valve, and between the second cam and the second valve, the variable mechanism adapted to change the valve-opening characteristics of at least one of the first valve and the second valve; and a displacement member adapted to move within a predetermined reciprocating range thereby switching between operational states of the variable mechanism, wherein the projection part is fixed to the displacement member.

A third aspect of the present invention is the variable valve operating apparatus for the internal combustion engine according to the first or second aspect of the present invention, wherein the projection part is disposed so as to fit in the oval-shaped region seen from the axial direction of the first and second camshafts in a state in which the projection part is not protruded toward the guide rail.

A fourth aspect of the present invention is the variable valve operating apparatus for the internal combustion engine according to any one of the first to third aspects of the present invention, wherein the actuator includes: a first movable element which is disposed, within the oval-shaped region, at a position where the first movable element is capable of protruding toward the cylindrical part attached to the first camshaft; and a second movable element which is disposed, within the oval-shaped region, at a position where the second movable element is capable of protruding toward the cylindrical part attached to the second camshaft.

A fifth aspect of the present invention is the variable valve operating apparatus for the internal combustion engine according to the fourth aspect of the present invention, wherein the first movable element and the second movable element are disposed to oppose each other and are disposed at a position where the first movable element and the second movable element are capable of protruding respectively toward the corresponding cylindrical part.

A sixth aspect of the present invention is the variable valve operating apparatus for the internal combustion engine according to the fourth or fifth aspect of the present invention, wherein the actuator is an electromagnetic solenoid type actuator, and includes a single electromagnetic coil which drives the first movable element and the second movable element.

A seventh aspect of the present invention is the variable valve operating apparatus for the internal combustion engine according to the third aspect of the present invention, wherein the actuator includes: a first movable element which is disposed, within the oval-shaped region, at a position where the first movable element is capable of protruding toward the cylindrical part attached to the first camshaft; and a second movable element which is disposed, within the oval-shaped region, at a position where the second movable element is capable of protruding toward the cylindrical part attached to the second camshaft, and wherein the projection part is respectively interposed between the guide rail attached to the first camshaft and the first movable element, and between the guide rail attached to the second camshaft and the second movable element.

An eighth aspect of the present invention is the variable valve operating apparatus for the internal combustion engine according to the seventh aspect of the present invention, wherein the actuator is an electromagnetic solenoid type actuator, and includes a single electromagnetic coil which drives the first movable element and the second movable element.

A ninth aspect of the present invention is the variable valve operating apparatus for the internal combustion engine according to any one of the first to eighth aspects of the present invention, further comprising:

a camshaft support member including a lower bearing part which supports the first and the second camshafts from a cylinder head side of the internal combustion engine, wherein the actuator is attached to the lower bearing part.

A tenth aspect of the present invention is the variable valve operating apparatus for the internal combustion engine according to the ninth aspect of the present invention, wherein the cylindrical part is disposed in proximity to the lower bearing part, and wherein the actuator is attached to the lower bearing part so as to be along at least one of: an upper bearing part which supports the first and second camshafts from an opposite side of the lower bearing part; and the lower bearing part.

An eleventh aspect of the present invention is the variable valve operating apparatus for the internal combustion engine according to any one of the first to third aspects of the present invention, further comprising:

a camshaft support member including a lower bearing part which supports the first and second camshafts from a cylinder head side of the internal combustion engine; and a head cover which covers the camshaft support member from an opposite side of the cylinder head, wherein the actuator is disposed in the head cover side with respect to the lower bearing part.

A twelfth aspect of the present invention is the variable valve operating apparatus for the internal combustion engine according to the eleventh aspect of the present invention, further comprising:

an oil injection member which is disposed inside the head cover and injects oil into an inside of the head cover, wherein the actuator is disposed in a direction of the oil injection by the oil injection member.

A thirteenth aspect of the present invention is the variable valve operating apparatus for the internal combustion engine according to the eleventh or twelfth aspect of the present invention, further comprising:

a fresh air passage which is disposed inside the head cover and makes fresh air flow into the inside of the head cover for processing of blow-by gas, wherein the actuator is disposed in a vicinity of an opening part of the fresh air passage inside the head cover.

Advantages of the Invention

According to the first aspect of the present invention, the actuator which is disposed so as to oppose the cylindrical part is disposed so as to fit in the above described oval-shaped region which is located between the first camshaft and the second camshaft. Thus, with the actuator being disposed inside the internal combustion engine, it becomes possible to effectively cool the actuator with oil which is supplied to the inside of the internal combustion engine. Moreover, such disposition makes it possible to dispose the actuator in sufficient proximity to the guide rail. This makes it easy to reduce the distance from the actuator to the contact portion with the guide rail in the projection part when the actuator protrudes the projection part toward the guide rail. As a result of that, the reduction of the distance makes it possible to favorably decrease the stress which acts on the actuator. As so far described, according to the present invention, it is possible to favorably improve the mounting environment of the actuator in the aspect of achieving the improvement of coolability and the reduction of stress.

According to the second aspect of the present invention, in the variable valve operating apparatus for the internal combustion engine having the configuration in which the above-described projection part is fixed to the displacement member for switching between operational states of the variable mechanism, it is possible to favorably improve the mounting environment of the actuator in the aspect of achieving the improvement of coolability and the reduction of stress.

According to the third aspect of the present invention, not only the actuator, but also the projection part is disposed to fit in the above-described oval-shaped region in a state in which the projection part is not protruded toward the guide rail. This makes it possible to effectively reduce the distance from the actuator to the contact portion with guide rail in the projection part when the actuator protrudes the projection part toward the guide rail. As a result of that, the reduction of the distance makes it possible to favorably decrease the stress which acts on the actuator.

According to the fourth aspect of the present invention, the first and the second movable elements of the actuator is disposed within the above-described oval-shaped region, thereby making it possible to effectively reduce the distance from these movable elements to the contact portion with the guide rail in the projection part when these movable elements protrude the projection part toward the guide rail. As a result of that, the reduction of the distance makes it possible to favorably decrease the stress which acts on the actuator.

According to the fifth aspect of the present invention, the first movable element and the second movable element are disposed so as to oppose each other, thereby resulting in that the repulsive driving forces of the two are canceled when the first movable element and the second movable element are driven at the same timing. This makes it possible to effectively suppress the vibration which occurs in the actuator when being driven.

According to the sixth aspect of the present invention, it is possible to concurrently drive both of the first and second movable elements by giving a command of a predetermined excitation current to the single electromagnetic coil. This makes it possible to reduce the number of actuators and the size thereof.

According to the seventh aspect of the present invention, it is possible to effectively reduce the distance from the movable element to the contact portion with the guide rail in the projection part when the first and second movable elements protrude the projection part toward the guide rail. As a result of that, a sufficient reduction of the distance makes it possible to more effectively decrease the stress which acts on the actuator.

According to the eighth aspect of the present invention, it is possible to concurrently drive both of the first and second movable elements by giving a command of a predetermined excitation current to the single electromagnetic coil. This makes it possible to reduce the number of actuators and the size thereof.

According to the ninth aspect of the present invention, it is possible to mount the actuator inside the internal combustion engine at a low cost and saving space without providing a new fixing position through the use of existing members which are provided to support the first and second camshafts.

According to the tenth aspect of the present invention, it is possible to facilitate the positioning between the guide rail provided in the first and second camshafts and the actuator.

According to the eleventh aspect of the present invention, it is made easier to effectively cool the actuator by means of oil and fresh air (fresh air introduced for the processing of the blow-by gas) which are supplied to the inside of the head cover.

According to the aspect of the present twelfth invention, oil injected from the oil injection member impinges on the actuator, thereby making it possible to effectively cool the actuator.

According to the aspect of the present thirteenth invention, fresh air supplied from the fresh air passage impinges directly on the actuator, thereby making it possible to effectively cool the actuator.

DESCRIPTION OF SYMBOLS

Figure 1:
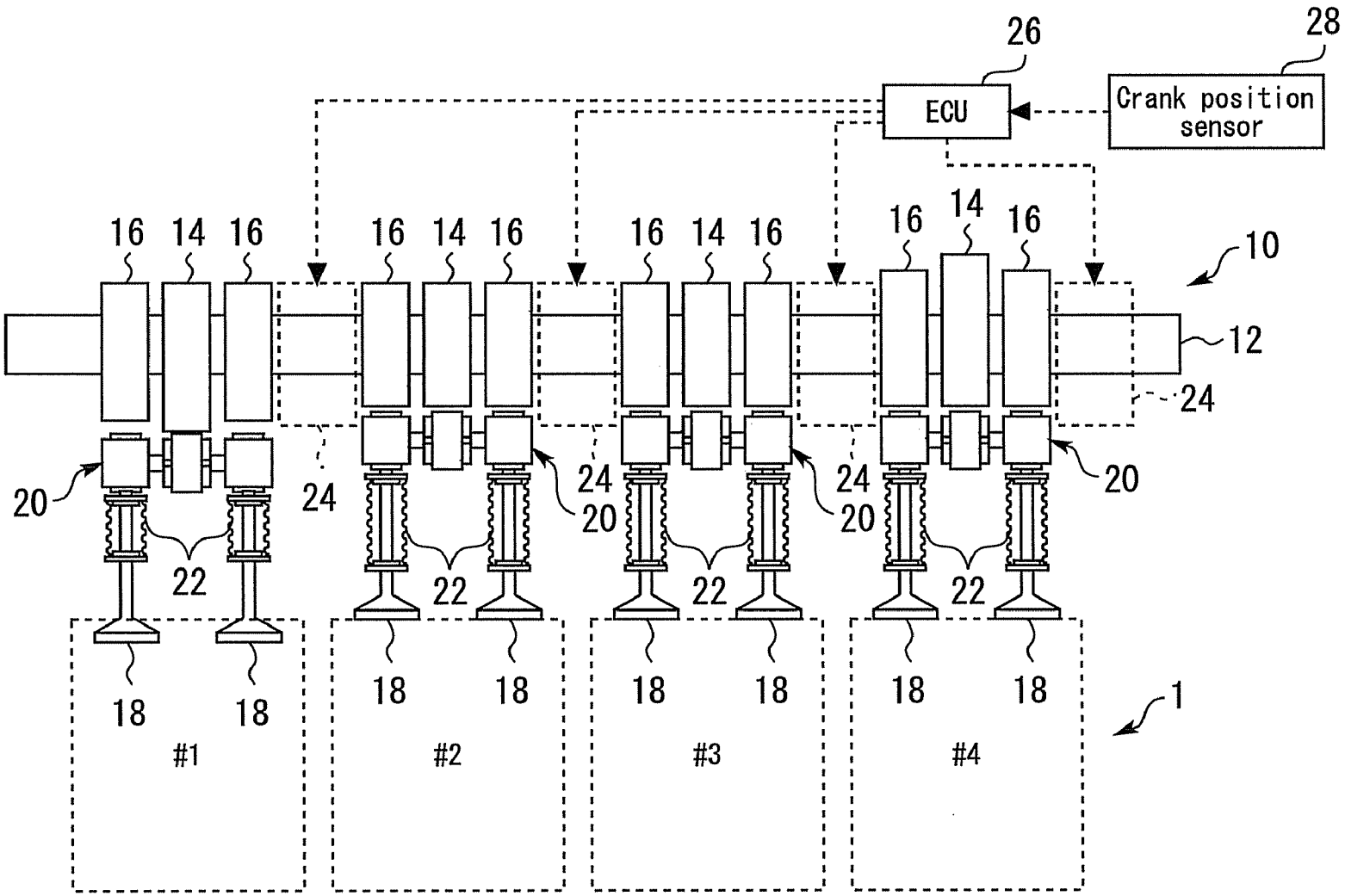
FIG. 1 is a schematic diagram showing the overall configuration for a intake variable valve operating apparatus for an internal combustion engine according to a first embodiment of the present invention.

1 internal combustion engine
10, 100 intake variable valve operating apparatus
12 intake camshaft
14 main cam
14*a* base circle part
14*b* nose part
16 auxiliary cam
18 intake valve
20 variable mechanism
24 changeover mechanism
26 ECU (Electronic Control Unit)
32 first rocker arm
34L, 34R second rocker arm
46 first pin hole
48 first changeover pin
52L, 52R second pin hole
54L, 54R second changeover pin
56 return spring
58, 104 slide pin
58*a* circular column part
58*b*, 104*b* arm part
58*c*, 104*c* projection part
58*d* pressing surface
58*e* notch part
58*f* guide surface
60 support member
62 cylindrical part
64 guide rail

64*a* proximal end
64*b* terminal end
64*c* shallow bottom part
66, 102 electromagnetic solenoid type actuator
66*a*, 102*a* movable element
66*b*, 102*b* actuator body
66*c*, 102*c* fixing part
70, 120 exhaust variable valve operating apparatus
72 exhaust camshaft
74 cylinder head
76 cam carrier
76*a* lower bearing part
76*b* concave part of cam carrier
78, 106 cam cap
84 stator
86 inner fixed iron core
86*a*, 86*b* end part of inner fixed iron core
88 electromagnetic coil
90, 92 permanent magnet
94, 96 outer fixed iron core
110 head cover
112 PCV chamber
114 baffle plate
116 oil shower pipe
116*a*, 116*b* injection hole
118 fresh air passage
118*a* opening part
Pmax1, Pmax2 displacement end

BEST MODE FOR CARRYING OUT THE INVENTION

First Embodiment

First, a first embodiment of the present invention will be described with reference to FIGS. 1 to 14.

[Overall Configuration of Variable Valve Operating Apparatus]

FIG. 1 is a schematic diagram showing the overall configuration of an intake variable valve operating apparatus 10 for an internal combustion engine 1 according to the first embodiment of the present invention.

Here, the internal combustion engine 1 is supposed to be a straight 4-cylinder engine having four cylinders (No. 1 to No. 4). Moreover, suppose that two intake valves 18 and two exhaust valves (not shown) are provided in each cylinder of the internal combustion engine 1. Note that description will herein be made on an example of an intake variable valve operating apparatus 10 for driving the intake valves 18. Moreover, since an exhaust variable valve operating apparatus 70 (see FIG. 11) is basically configured in the same manner as the intake variable valve operating apparatus 10, the detailed description thereof will herein be omitted.

The intake variable valve operating apparatus 10 of the present embodiment includes a camshaft 12. The camshaft 12 is connected to a crankshaft, which is not shown, by means of a timing chain or a timing belt and is configured to rotate at a half speed of that of the crankshaft. The camshaft 12 is formed with a main cam 14 and two auxiliary cams 16 for one cylinder. The main cam 14 is disposed between two auxiliary cams 16.

The main cam 14 includes an arc-shaped base circle part 14*a* (see FIG. 3) concentric with the camshaft 12, and a nose part 14*b* (see FIG. 3) which is formed such that a part of the base circle expands outwardly in the radial direction. Moreover, in the present embodiment, the auxiliary cam 16 is configured to be a cam which includes only a base circle part (a zero lift cam) (see FIG. 4).

A variable mechanism 20 is interposed between the cam 14, 16 and the intake valve 18 (hereafter, simply abbreviated as the "valve") of each cylinder. That is, the acting forces of the cams 14 and 16 are arranged to be transferred to the two valves 18 via the variable mechanism 20. The valve 18 is adapted to be opened and closed by use of the acting force of the cams 14 and 16, and the biasing force of valve spring 22.

The variable mechanism 20 is a mechanism to change the valve-opening characteristics of the valve 18 by switching between the state in which the acting force of the main cam 14 is transferred to the valve 18 and the state in which the acting force of the auxiliary cam 16 is transferred to the valve 18. Note that, in the present embodiment, since the auxiliary cam 16 is a zero-lift cam, the state in which the acting force of the auxiliary cam 16 is transferred to the valve 18 refers to a state in which neither opening nor closing of the valve 18 take place (a valve halted state).

Moreover, the intake variable valve operating apparatus 10 of the present embodiment includes, for each cylinder, a changeover mechanism 24 for driving each variable mechanism 20 to switch between operational states of the valve 18. The changeover mechanism 24 is adapted to be driven according to a driving signal from an ECU (Electronic Control Unit) 26. The ECU 26, which is an electronic control unit for controlling the operating state of the internal combustion engine 1, controls the changeover mechanism 24 based on the output signal of a crank position sensor 28 and the like. The crank position sensor 28 is a sensor for detecting a rotational speed of the output shaft (crankshaft) of the internal combustion engine 1.

(Configuration of Variable Mechanism)

Next, a detailed configuration of the variable mechanism 20 will be described with reference to FIGS. 2 to 4.

Figure 2:
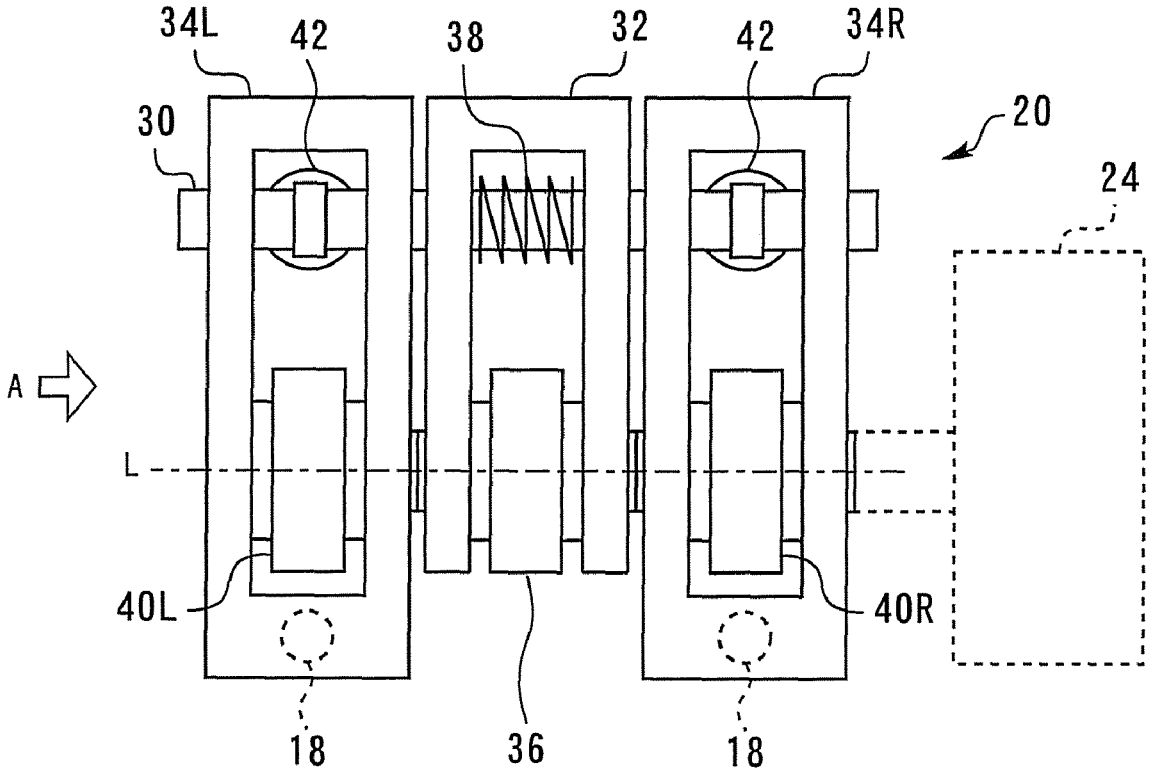
FIG. 2 is a look-down view of the variable mechanism shown in FIG. 1 seen from the proximal end part side of the valve.

FIG. 2 is a look-down view of the variable mechanism 20 shown in FIG. 1 seen from the proximal end part side of the valve 18.

The variable mechanism 20 includes a rocker shaft 30 which is disposed in parallel with the camshaft 12. As shown in FIG. 2, a first rocker arm 32 and a pair of second rocker arms 34R and 34L are rotatably attached to the rocker shaft 30. The first rocker arm 32 is disposed between the two second rocker aims 34R and 34L. Note that, in the present description, the right and left second rocker arms 34R and 34L may be referred to simply as a second rocker arm 34 when they are not particularly discriminated.

Figure 3:
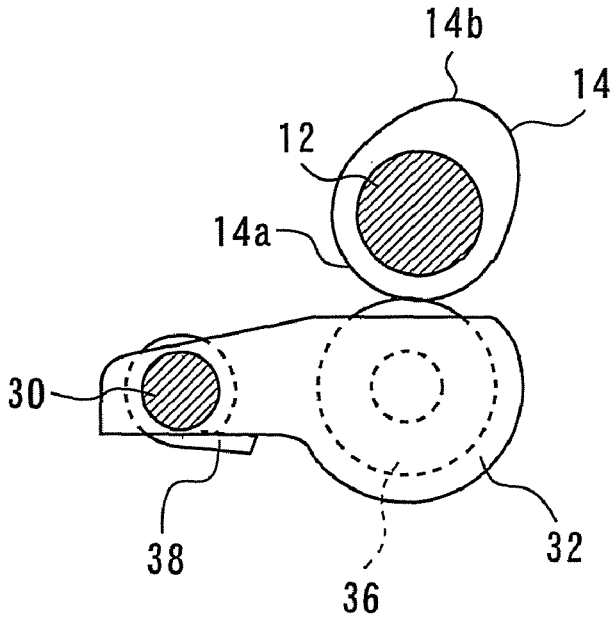
FIG. 3 is a view of a first rocker arm seen from the axial direction (the direction shown by an arrow A in FIG. 2) of a rocker shaft.
Figure 4:
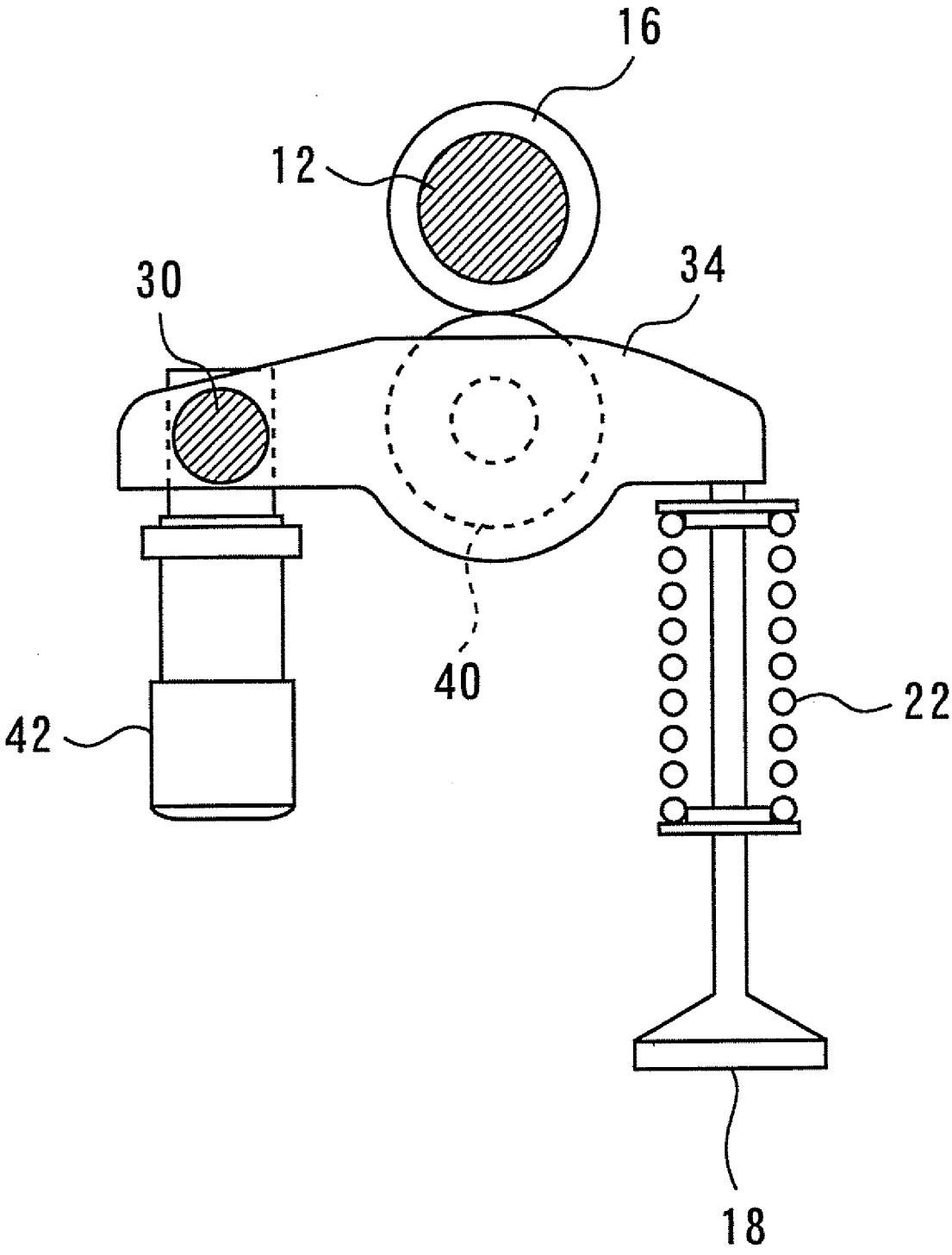
FIG. 4 is a view of a second rocker arm seen from the axial direction (the direction shown by the arrow A) of the rocker shaft in the same manner as in FIG. 3.

FIG. 3 is a view of the first rocker arm 32 seen from the axial direction (the direction shown by an arrow A in FIG. 2) of the rocker shaft 30, and FIG. 4 is a view of the second rocker arm 34 seen from the axial direction (the direction shown by the arrow A) of the rocker shaft 30 in the same manner as in FIG. 3.

As shown in FIG. 3, a first roller 36 is rotatably attached to the end part opposite to the rocker shaft 30 in the first rocker arm 32 at a position which allows a contact with the main cam 14. The first rocker aim 32 is biased by a coil spring 38 attached to the rocker shaft 30 such that the first roller 36 is constantly in abutment with the main cam 14. The first rocker arm 32 configured as described above oscillates with the rocker shaft 30 as a fulcrum through the cooperation between the acting force of the main cam 14 and the biasing force of the coil spring 38.

On the other hand, as shown in FIG. 4, the proximal end part of the valve 18 (specifically, the proximal end part of the valve stem) is in abutment with the end part opposite to the rocker shaft 30 in the second rocker arm 34. Moreover, a second roller 40 is rotatably attached to a central portion of the second rocker arm 34.

Moreover, it is supposed that the rocker shaft 30 is supported by a cylinder head 74 (see FIG. 11) via a rush adjuster 42 at the other end of the second rocker arm 34. Therefore, the second rocker arm 34 is biased toward the auxiliary cam 16 by being subjected to an upward force from the rush adjuster 42.

Further, the position of the second roller 40 with respect to the first roller 36 is defined such that the axial center of the second roller 40 and the axial center of the first roller 36 are positioned on the same straight line L as shown in FIG. 2, when the first roller 36 is in abutment with the base circle part 14*a* of the main cam 14 (see FIG. 3) and the second roller 40 is in abutment with the base circle part of the auxiliary cam 16 (see FIG. 4).

(Configuration of Changeover Mechanism)

Next, a detailed configuration of the changeover mechanism 24 will be described with reference to FIGS. 5 and 6.

The changeover mechanism 24, which is a mechanism for switching the connection and disconnection concerning the first rocker arm 32 and the second rocker arm 34, makes it possible to switch the operational states of the valve 18 between a valve operable state and valve stop state by switching the state in which the acting force of the main cam 14 is transferred to the second rocker arm 34 and the state in which the forgoing acting force is not transferred to the second rocker arm 34.

Figure 5:
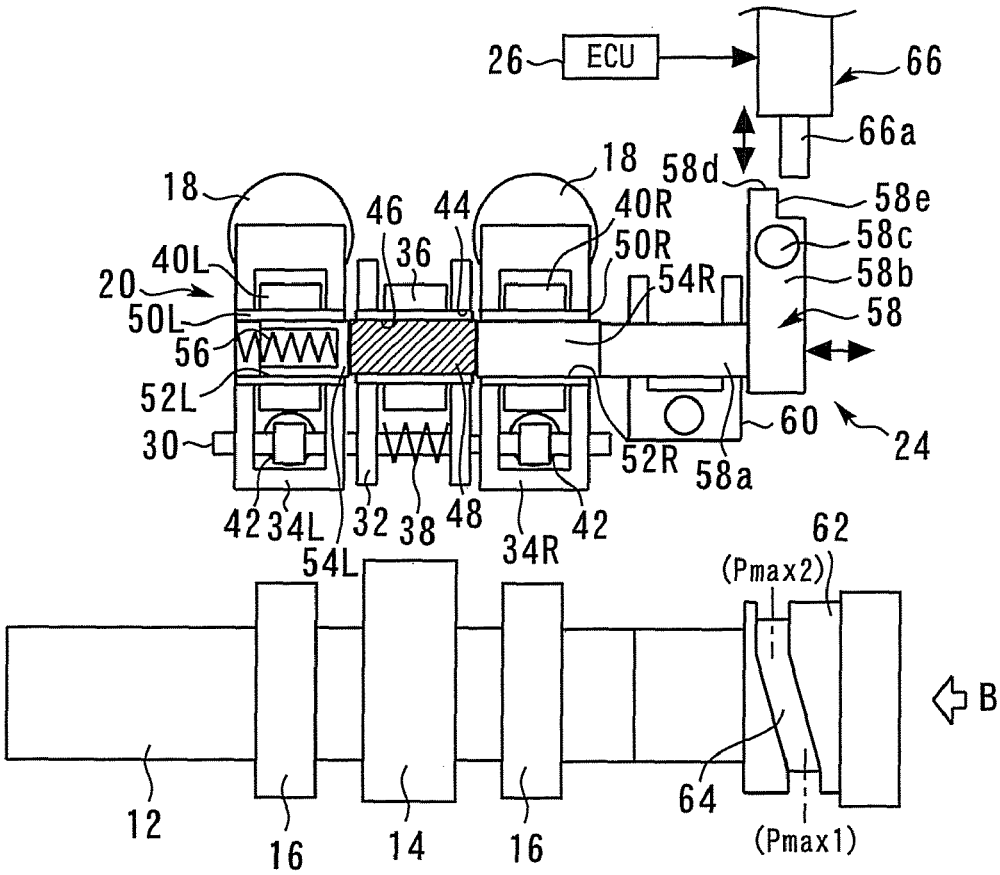
FIG. 5 is a diagram illustrating a detailed configuration of the changeover mechanism shown in FIG. 1.

FIG. 5 is a diagram illustrating a detailed configuration of the changeover mechanism 24 shown in FIG. 1. Note that, in FIG. 5, the variable mechanism 20 is represented by using a section taken at the axial centers of the rollers 36 and 40. Moreover, for the sake of simplicity of description, the mounting position of the camshaft 12 with respect to the mounting position of the variable mechanism 20 is represented in a state different from the actual mounting position excepting the axial position of the camshaft 12.

As shown in FIG. 5, a first pin hole 46 is formed within a first spindle 44 of the first roller so as to pass through in its axial direction, and the both ends of the first pin hole 46 are opened to both side surfaces of the first rocker arm 32. A first changeover pin 48 having a circular column shape is slidably inserted into the first pin hole 46. The outer diameter of the first changeover pin 48 is substantially equal to the inner diameter of the first pin hole 46, and the axial length of the first changeover pin 48 is substantially equal to the length of the first pin hole 46.

On the other hand, there is formed inside a second spindle 50L of the second roller 40 of the second rocker arm 34L side, a second pin hole 52L of which end part opposite to the first rocker arm 32 is closed and of which end part of the first rocker arm 32 side is opened. Moreover, inside a second spindle 50R of the second roller 40 of the second rocker arm 34R side, a second pin hole 52R is formed so as to pass through in its axial direction, and both ends of the second pin hole 52R are opened to the both side surfaces of the second rocker arm 34R. The inner diameters of the second pin holes 52R and 52L are equal to the inner diameter of the first pin hole 46.

A second changeover pin 54L of a circular column shape is slidably inserted into the second pin hole 52L. Moreover, inside the second pin hole 52L, there is disposed a return spring 56 which biases the second changeover pin 54L toward the first rocker arm 32 direction (hereafter, referred to as the "advancing direction of changeover pin"). The outer diameter of the second changeover pin 54L is substantially equal to the inner diameter of the second pin hole 52L. Moreover, the axial length of the second changeover pin 54L is arranged to be shorter than that of the second pin hole 52L, and an adjustment is made such that the distal end of the second changeover pin 54L slightly protrudes from the side surface of the second rocker arm 34L with the second changeover pin 54L being pressed toward inside the second pin hole 52L. Further, it is supposed that the return spring 56 is configured to, in a mounted state, constantly bias the second changeover pin 54L toward the first rocker arm 32.

A second changeover pin 54R of a circular column shape is slidably inserted into the second pin hole 52R. The outer diameter of the second changeover pin 54R is substantially equal to the inner diameter of the second pin hole 52R, and the axial length of the second changeover pin 54R is substantially equal to the length of the second pin hole 52R.

The relative positions of three pin holes 46, 52L, and 52R described so far are defined such that the axial centers of the three pin holes 46, 52L, and 52R are positioned on the same straight line L, when the first roller 36 is in abutment with the base circle part 14*a* of the main cam 14 (see FIG. 3) and the second roller 40 is in abutment with the base circle part of the auxiliary cam 16 (see FIG. 4).

Figure 6:
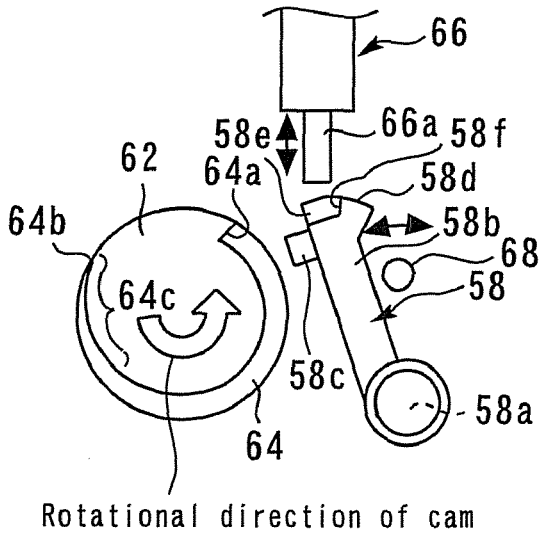
FIG. 6 is a view of the changeover mechanism seen from the axial direction of a camshaft (the direction of an arrow B in FIG. 5)

Here, newly referring to FIG. 6 as well as above-described FIG. 5, description on the changeover mechanism 24 will be continued. FIG. 6 is a view of the changeover mechanism 24 seen from the axial direction of the camshaft 12 (the direction of an arrow B in FIG. 5).

The changeover mechanism 24 includes a slide pin 58 for forcing the changeover pins 48, 54L, and 54R to be displaced toward the second rocker arm 34L side (in the retreating direction of the changeover pin) with the aid of the rotational power of the cam. The slide pin 58 includes, as shown in FIG. 5, a circular column part 58*a* having a end face which is in abutment with the end face of the second changeover pin 54R. The circular column part 58*a* is supported by a support member 60 fixed to the cylinder head 74 (see FIG. 11) so as to be advanceable/retreatable in the axial direction and rotatable in the circumferential direction.

Moreover, a bar-like arm part 58*b* is provided so as to protrude outwardly in the radial direction of the circular column part 58*a* at the end part opposite to the second changeover pin 54R in the circular column part 58*a*. That is, the arm part 58*b* is configured to be rotatable around the axial center of the circular column part 58*a*. The distal end part of the arm part 58*b* is configured, as shown in FIG. 6, to extend up to a position opposed to the outer peripheral surface of the camshaft 12. Moreover, a projection part 58*c* is provided at the distal end part of the arm part 58*b* so as to protrude toward the outer peripheral surface of the camshaft 12.

There is formed in the outer peripheral surface opposed to the projection part 58*c* in the camshaft 12, a cylindrical part 62 having a larger diameter than that of the camshaft 12. There is formed in the outer peripheral surface of the cylindrical part 62, a helical-shaped guide rail 64 extending in the circumferential direction. Here, the guide rail 64 is shaped as a helical groove.

Moreover, the changeover mechanism 24 includes an electromagnetic solenoid type actuator 66 for engaging (inserting) the projection part 58*c* with (into) the guide rail 64. Note that a detailed configuration of this actuator 66 will be described later with reference to FIGS. 11 to 14.

Moreover, it is supposed that the actuator 66 is disposed at a position where a movable element 66*a* thereof can press the pressing surface (the surface opposite to the surface where the projection part 58*c* is provided) 58*d* of the distal end part of the arm part 58*b* of the slide pin 58 against the guide rail 64. In other words, the pressing surface 58*d* is provided in a shape and at a position where the projection part 58*c* can be pressed toward the guide rail 64 by the movable element 66*a*.

The arm part 58*b* of the slide pin 58 is arranged to be rotatable around the axial center of the circular column part 58*a* within a range restricted by the cylindrical part 62 of the camshaft 12 side and a stopper 68. Then, the positional relationship of each component is arranged such that when the aim part 58*b* is within the abovementioned range, and when the axial position of the slide pin 58 is at a displacement end Pmax1 described later, the movable element 66*a* driven by the actuator 66 can come into abutment with the pressing surface 58*d* of the arm part 58*b* securely.

The helical direction in the guide rail 64 of the camshaft 12 is arranged such that when the camshaft 12 is rotated in a predetermined rotational direction shown in FIG. 6 with the projection part 58*c* being inserted thereinto, the slide pin 58 causes the changeover pins 48, 54L, and 54R to be displaced in the direction approaching the rocker arms 32 and 34 while pushing aside them in the retreating direction against the biasing force of the return spring 56.

Here, the position of the slide pin 58, in a state where the second changeover pin 54L is inserted into both the second pin hole 52L and the first pin hole 46 by the biasing force of the return spring 56, and where the first changeover pin 48 is inserted into both the first pin hole 46 and the second pin hole 52R, is referred to as a "displacement end Pmax1". When the slide pin 58 is positioned at this displacement end Pmax1, the first rocker arm 32 and the second rocker arms 34R and 34L all become connected with each other. Moreover, the position of the slide pin 58 in a state where as a result of the changeover pin 48 and the like being subjected to a force from the slide pin 58, the second changeover pin 54L, the first changeover pin 48, and the second changeover pin 54R are respectively inserted only into the second pin hole 52L, the first pin hole 46, and the second pin hole 52R, is referred to as a "displacement end Pmax 2". That is, when the slide pin 58 is positioned at this displacement end Pmax2, the first rocker arm 32, and the second rocker arms 34R and 34L are all disconnected from each other.

In the present embodiment, the position of the proximal end 64*a* of the guide rail 64 in the axial direction of the camshaft 12 is arranged so as to coincide with the position of the projection part 58*c* when the slide pin 58 is positioned at the above-described displacement end Pmax1. Further, the position of the terminal end 64*b* of the guide rail 64 in the axial direction of the camshaft 12 is arranged so as to coincide with the position of the projection part 58*c* when the slide pin 58 is positioned at the above-described displacement end Pmax2. That is, in the present embodiment, the configuration is made such that the slide pin 58 is displaceable between the displacement end Pmax1 and the displacement end Pmax2 within the range in which the projection part 58*c* is guided by the guide rail 64.

Further, as shown in FIG. 6, the guide rail 64 of the present embodiment is provided with a shallow bottom part 64*c*, in which the depth of the guide rail 64 gradually decreases as the camshaft 12 rotates, as a predetermined section of the terminal end 64*b* side after the slide pin 58 reaches the displacement end Pmax2. Note that the depth of the portion other than the shallow bottom part 64*c* in the guide rail 64 is constant.

Moreover, the arm part 58*b* in the present embodiment is provided with a notch part 58*e* which is formed into a concave shape by notching a part of a pressing surface 58*d*. The pressing surface 58*d* is provided so as to be kept in abutment with the movable element 66*a* while the slide pin 58 is displaced from the displacement end Pmax1 to the displacement end Pmax2. Further, the notch part 58*e* is provided in a portion where it can be engaged with the movable element 66*a* when the projection part 58*c* is taken out on the surface of the cylindrical part 62 by the action of the above-described shallow bottom part 64*c*, in a state where the slide pin 58 is positioned at the above-described displacement end Pmax2.

Moreover, the notch part 58*e* is formed so as to be engaged with the movable element 66*a* in a mode in which the rotation of the arm part 58*b* in the direction in which the projection part 58*c* is inserted into the guide rail 64 can be restricted, and the movement of the slide pin 58 in the advancing direction of the changeover pin can be restricted. To be more specific, there is provided in the notch part 58*e*, a guide surface 58*f* which guides the slide pin 58 to move away from the cylindrical part 62 as the movable element 66*a* moves into the notch part 58*e*.

[Operation of the Variable Valve Operating Apparatus]

Next, the operation of the intake variable valve operating apparatus 10 will be described with reference to FIGS. 7 to 10.

(At the Time of Valve Operable State)

Figure 7:
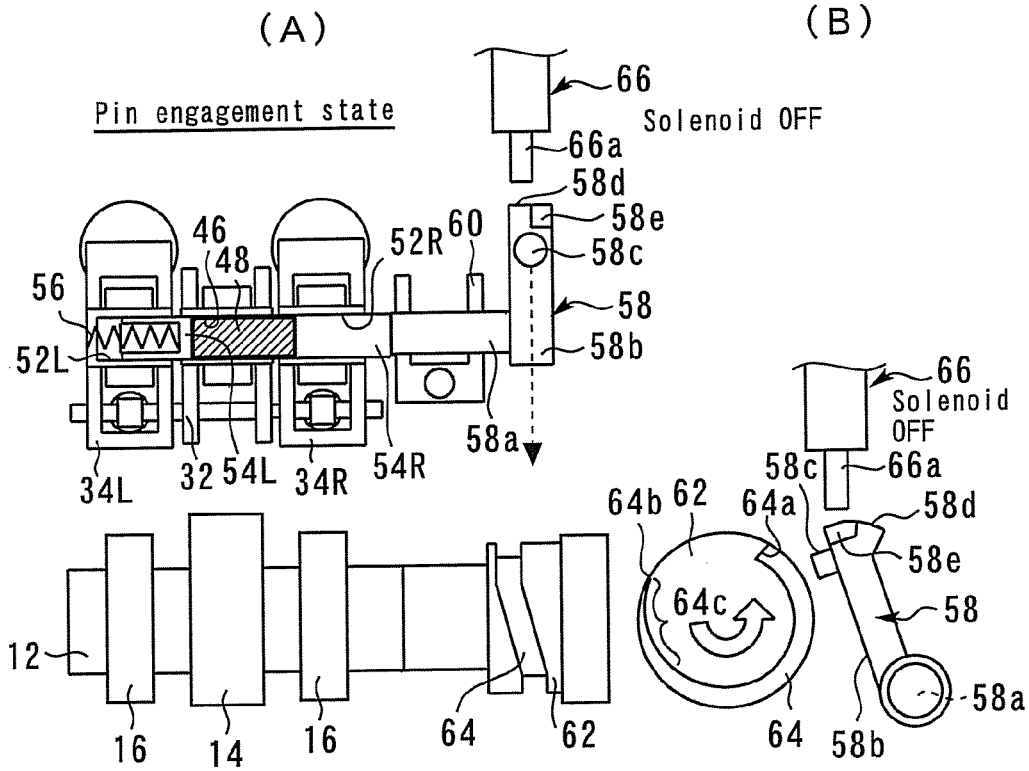
FIG. 7 is a diagram showing a control state during a valve operable state (normal lift operation)

FIG. 7 is a diagram showing a control state during a valve operable state (normal lift operation).

In this case, as shown in FIG. 7(B), the driving of the actuator (solenoid) 66 is turned OFF and thus the slide pin 58 is positioned at the displacement end Pmax1 being separated from the camshaft 12 and subjected to the biasing force of the return spring 56. In this state, as shown in FIG. 7(A), the first rocker arm 32 and the two second rocker arms 34 are connected via the changeover pins 48 and 54L. As a result of that, the acting force of the main cam 14 is transferred from the first rocker arm 32 to both the valves 18 via the left and right second rocker arms 34R and 34L. Thus, the normal lift operation of the valve 18 is performed according to the profile of the main cam 14.

(At the Start of Valve Stop Operation (the Start of Slide Operation))

Figure 8:
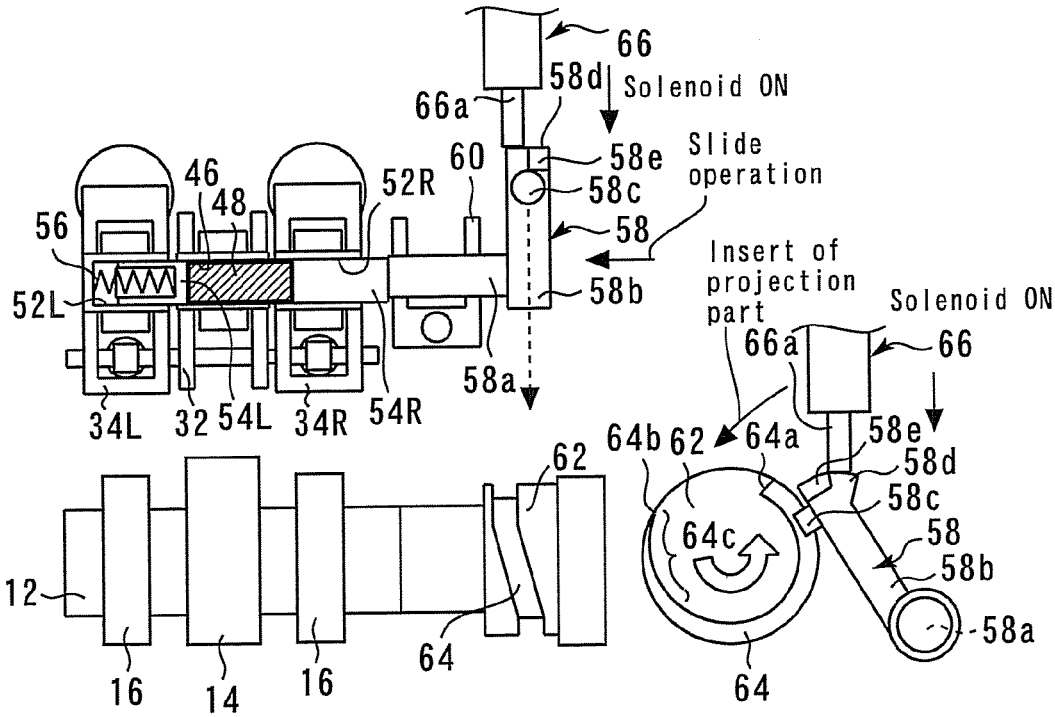
FIG. 8 is a diagram showing a control state at the start of a valve stop operation.

FIG. 8 is a diagram showing a control state at the start of a valve stop operation.

The valve stop operation is performed when, for example, an execution request of a predetermined valve stop operation such as a fuel cut request of the internal combustion engine 1 is detected by the ECU 26. Since such valve stop operation is an operation to displace the changeover pins 48, 54L, and 54R in their retreating direction by means of the slide pin 58 with the aid of the rotational force of the camshaft 12, such operation needs to be performed while the axial centers of these changeover pins 48, 54L, and 54R are positioned on the same straight line, that is, while the first rocker arm 32 is not oscillating.

In the present embodiment, the guide rail 64 is arranged such that the displacement section of the slide pin 58 in the retreating direction of changeover pins is within the base circle section. As a result of this, when the ECU 26 detects an execution request for a predetermined valve stop operation, with the actuator 66 being driven in the order starting from a cylinder at which the base circle section first arrives, as shown in FIG. 8(B), the projection part 58*c* is inserted into the guide rail 64, thereby successively starting the valve stop operation of each cylinder. Then, as the projection part 58*c* which has been inserted into the guide rail 64 being guided by the guide rail 64, a slide operation of the slide pin 58 is started toward the displacement end Pmax2 side, as shown in FIG. 8(A), with the aid of the rotational force of the camshaft 12.

(At the Completion of Slide Operation)

Figure 9:
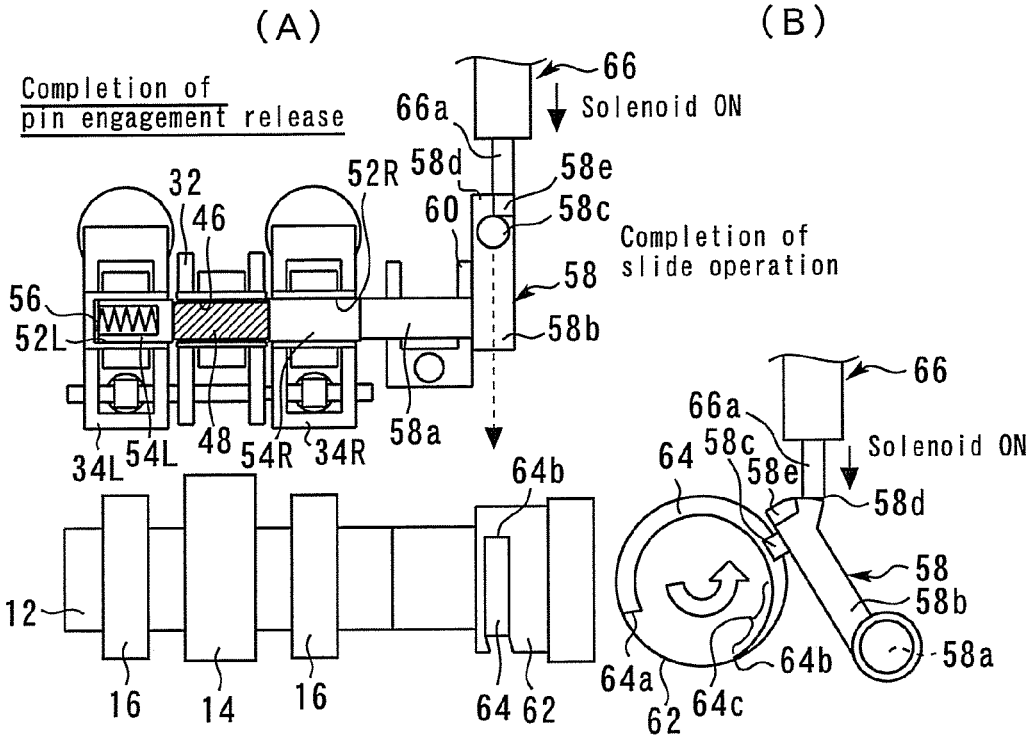
FIG. 9 is a diagram showing a control state at the completion of a slide operation.

FIG. 9 is a diagram showing a control state at the completion of the slide operation.

During the execution of the slide operation, the slide pin 58 moves toward the displacement end Pmax2, in a state in which the biasing force of the return spring 56 is received by the projection part 58*c* being in abutment with the side surface of the guide rail 64. FIG. 9(A) shows a timing at which the slide pin 58 has reached the displacement end Pmax2 and the slide operation at the time of a valve stop request is completed, that is, a timing at which the connection between the first rocker arm 32 and the second rocker arms 34R and 34L is released as a result of the first changeover pin 48 and the second changeover pin 54L becoming accommodated into the first pin hole 46 and the second pin hole 52L, respectively. Moreover, at this timing, as shown in FIG. 9(B), the position of the projection part 58*c* within the guide rail 64 has not yet reached the shallow bottom part 64*c*.

When the slide operation is completed as shown above, and the first rocker arm 32 and the second rocker arms 34R and 34L become disconnected, the first rocker arm 32, which is biased by the coil spring 38 toward the main cam 14 as the main cam 14 rotates, comes to oscillate by itself. As a result of this, the acting force of the main cam 14 is not transferred to the two second rocker arms 34. Further, since the auxiliary cam 16, against which the second rocker arm 34 abuts, is a zero lift cam, the force for driving the valve 18 is no more provided to the second rocker arms 34, to which the acting force of the main cam 14 has come not to be transferred. As a result of that, since, regardless of the rotation of the main cam 14, the second rocker arm 34 comes into a stationary state, the lift operation of the valve 18 becomes stopped at the valve closing position.

(At the Time of Holding Operation of Displacement Member)

Figure 10:
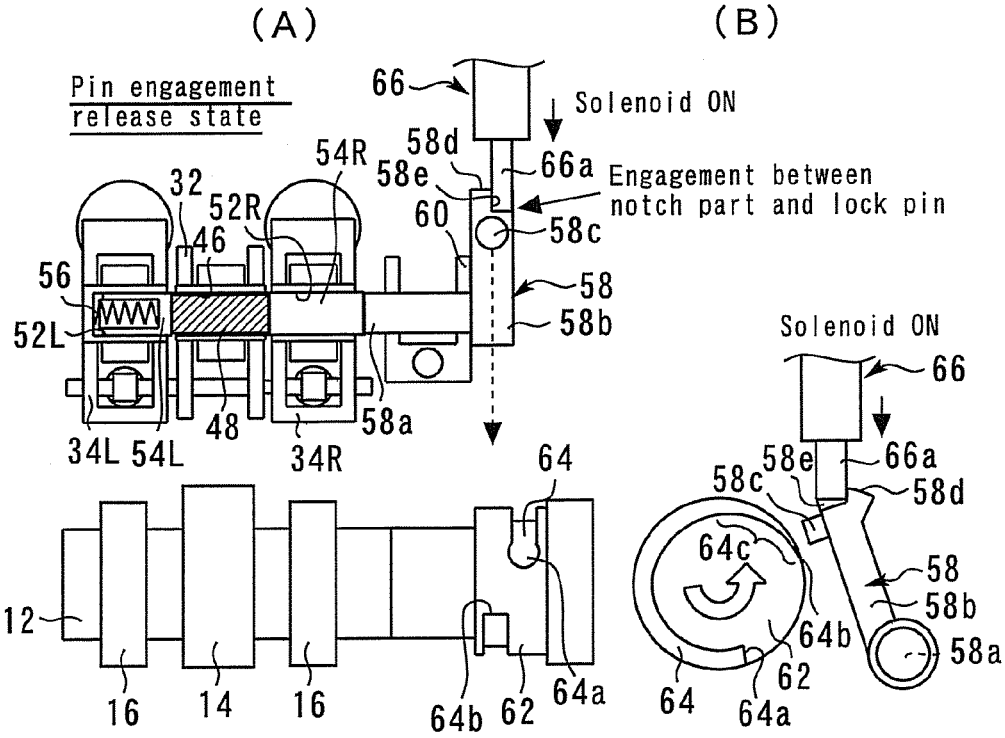
FIG. 10 is a diagram showing a control state at the time of holding operation to hold a slide pin with a movable element.

FIG. 10 is a diagram showing a control state at the time of holding operation to hold the slide pin 58 with the movable element 66*a*.

When the camshaft 12 further rotates after the slide operation shown in above-described FIG. 10 is completed, the projection part 58*c* comes close to the shallow bottom part 64*c* in which the depth of the groove gradually decreases. As a result of that, the action of the shallow bottom part 64*c* causes the slide pin 58 to rotate in the direction separated from the camshaft 12. Then, as the depth of the groove decrease due to the shallow bottom part 64*c*, the movable element 66*a* is displaced a little in its retreating direction. Thereafter, when the slide pin 58 further rotates until the movable element 66*a* which is constantly driven by the actuator 66, coincides with the notch part 58*e*, the portion of the slide pin 58 side, which is to be abutment with the movable element 66*a*, is switched from the pressing surface 58*d* to the notch part 58*e*.

As a result of that, the movable element 66*a* comes to be engaged with the notch part 58*e*. As a result of this, as shown in FIG. 10(B), the slide pin 58 comes to be held with the projection part 58*c* being separated from the camshaft 12, and with the biasing force of the return spring 56 being received by the movable element 66*a*. For this reason, in this holding operation, as shown in FIG. 10(A), the state in which the first rocker arm 32 and the second rocker aim 34 are disconnected, that is, the valve stop state is maintained.

(At the Time of Valve Return Operation)

A valve return operation for returning the operation from the valve stop state to the valve operable state, for example, when an execution request of a predetermined valve return operation such as a request for returning from a fuel cut is detected by the ECU 26. Such valve return operation is started by the ECU 26 turning OFF the energization to the actuator 66 at a predetermined timing (timing that is earlier than the start timing of the base circle section, in which the changeover pin 48 and the like are movable, by a predetermined time period needed for the operation of the actuator 66), in a control state shown in FIG. 10. When the energization to the actuator 66 is turned OFF, the engagement between the notch part 58*e* of the slide pin 58 and the movable element 66*a* is released. As a result of that, the force to hold the first changeover pin 48 and the second changeover pins 54L respectively in the first pin hole 46 and the second pin hole 52L against the biasing force of the return spring 56 disappears.

Because of this, when the base circle section in which the positions of changeover pins 48, 54L, and 54R coincide arrives, the changeover pins 48 and 54L moves in the advancing direction by the biasing force of the return spring 56, thereby returning into a state in which the first rocker arm 32 and the two second rocker arms 34 are connected via the changeover pins 48 and 54L, that is, a state in which a lift operation of the valve 18 is enabled by the acting force of the main cam 14. Moreover, as the changeover pins 48 and 54L moves in the advancing direction by the biasing force of the return spring 56, the slide pin 58 is returned from the displacement end Pmax2 to the displacement end Pmax1 via the second changeover pin 54R.

(Summary)

According to the intake variable valve operating apparatus 10 of the present embodiment thus configured, it becomes possible to switch the operational states of the valve 18 between the valve operable state and the valve stop state by moving the axial position of the slide pin 58 between the displacement end Pmax1 and the displacement end Pmax2, with the aid of the ON and OFF of the energization to the actuator 66, the rotational force of the camshaft 12, and the biasing force of the return spring 56.

To be more specific, when the valve stop request is made, by turning ON the energization to the actuator 66 thereby inserting the projection part 58*c* into the guide rail 64, it is made possible to move the changeover pin 48 and the like in the retreating direction of changeover pin with the slide pin 58 which utilizes the rotational force of the camshaft 12. As a result of that, it becomes possible to quickly switch the first rocker arm 32 and the two second rocker arms 34 from the connected state to the disconnected state within one base circle section. This makes it possible to obtain the valve stop state. Moreover, when a valve return request is made, by turning OFF the energization to the actuator 66 thereby releasing the engagement between the slide pin 58 and the movable element 66*a*, it is made possible to move the changeover pin 48 and the like and the slide pin 58 in the advancing direction of changeover pin, with the aid of the biasing force of the return spring 56. As a result of that, it becomes possible to quickly switch the first rocker arm 32 and the two second rocker arms 34 from the disconnected state to the connected state within one base circle section, and also to return the slide pin 58 to an original position (Pmax1) at which the valve stop operation can be started. This makes it possible to quickly resume the operational state of the valve 18 to the valve operable state.

Moreover, according to the above-described intake variable valve operating apparatus 10, by engaging the movable element 66*a* with the notch part 58*e* after the slide pin 58 reaches the displacement end Pmax2 at which the slide operation of the slide pin 58 is completed, it becomes possible to transfer the function of holding the slide pin 58 such that it is not displaced from the displacement end Pmax2 to the displacement end Pmax1 side due to the biasing force of the return spring 56, from the side surface of the guide rail 64 which is engaged with the projection part 58*c* to the movable element 66*a* which is engaged with the notch part 58*e*. The arrangement is, as already described, such that in a state in which the slide pin 58 is held by the engagement between the movable element 66*a* and the notch part 58*e*, the projection part 58*c* is kept separated from the camshaft 12. In this arrangement, as a result of the holding of the slide pin 58 being changed to the movable element 66*a* which is stationary with respect to the axial direction after the completion of the valve stop operation, it becomes possible to avoid the occurrence of friction and attrition in association with the sliding with the rotating camshaft 12. To be more specific, the elimination of friction allows an improvement of the fuel economy of the internal combustion engine 1. Further, the elimination of the attrition of the slide pin 58 allows the control positions of the changeover pin 48 and the like to be stabilized, thereby making it possible to ensure favorable switchability of the operational states of the valve 18. In further addition, according to the configuration of the intake variable valve operating apparatus 10 of the present embodiment, the above-described holding function is realized between the movable element 66*a* of the actuator 66 which operates integrally with the solenoid 68 which is provided for the purpose of inserting the projection part 58*c*, and the notch part 58*e* which is provided in the slide pin 58 which is provided for the purpose of moving the changeover pin 48 and the like. Therefore, it is possible to obtain the intake variable valve operating apparatus 10 which can favorably switch between the operational states of the valve 18 by using a simplified configuration, without leading to an increase in the number of components.

[Specific Configuration of Electromagnetic Solenoid Type Actuator of the First Embodiment]

(Mounting Position and Fixing Method of Electromagnetic Solenoid Type Actuator)

First, the mounting position and fixing method of the electromagnetic solenoid type actuator 66 will be described with reference to FIGS. 11 and 12.

Figure 11:
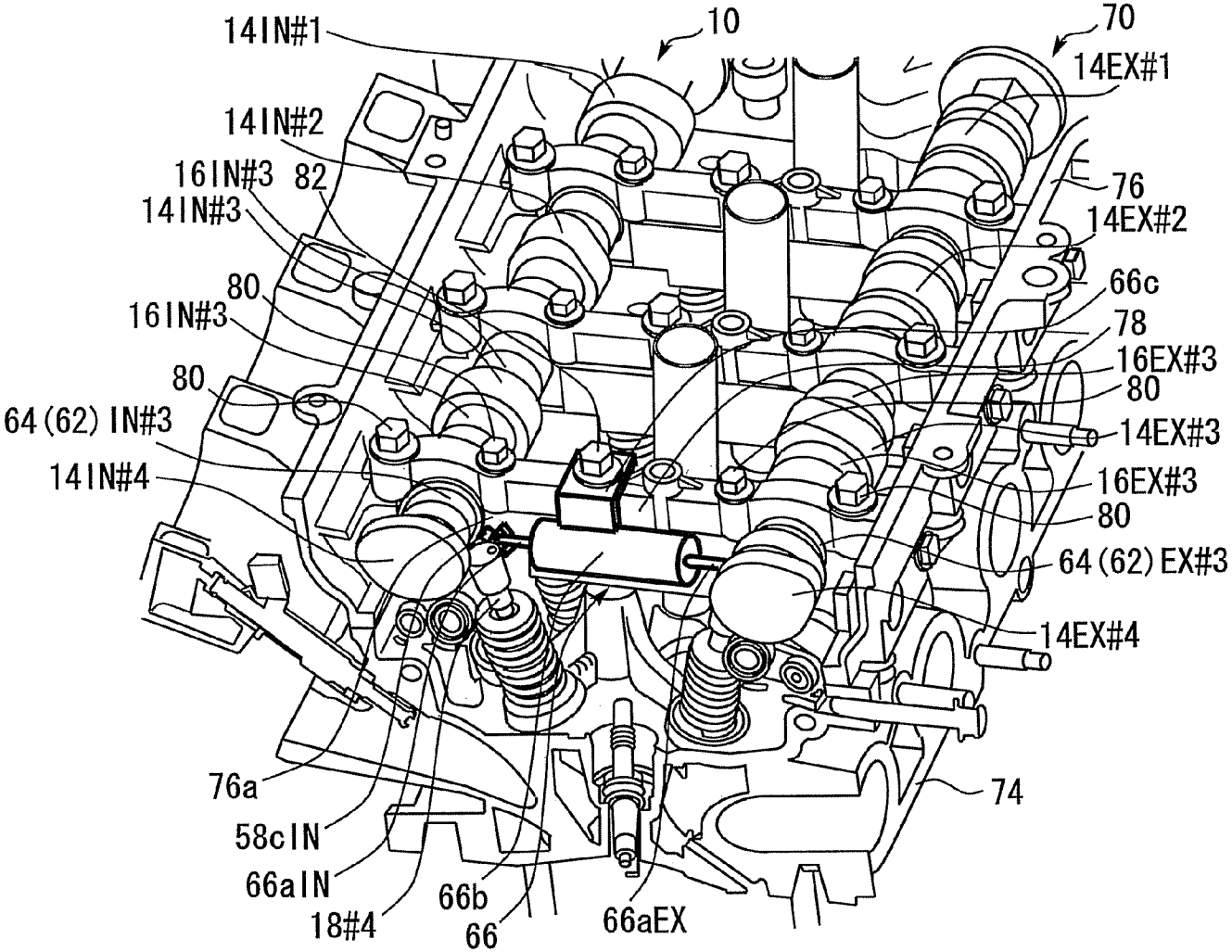
FIG. 11 is a perspective view to illustrate the arrangement of an electromagnetic solenoid type actuator shown in FIG. 5.

FIG. 11 is a perspective view to illustrate the arrangement of the electromagnetic solenoid type actuator 66 shown in FIG. 5. To be more specific, in FIG. 11, located on the left is the intake variable valve operating apparatus 10, and located on the right is the exhaust variable valve operating apparatus 70. Moreover, the sectional surfaces in FIG. 11 include those of the cylinder head 74 and its mounted members which are sectioned at the center of No. 4 cylinder. Further, in FIG. 11, the electromagnetic solenoid type actuator 66 is typically shown only for No. 3 cylinder, omitting the illustration of the actuators 66 for other cylinders.

Figure 12:
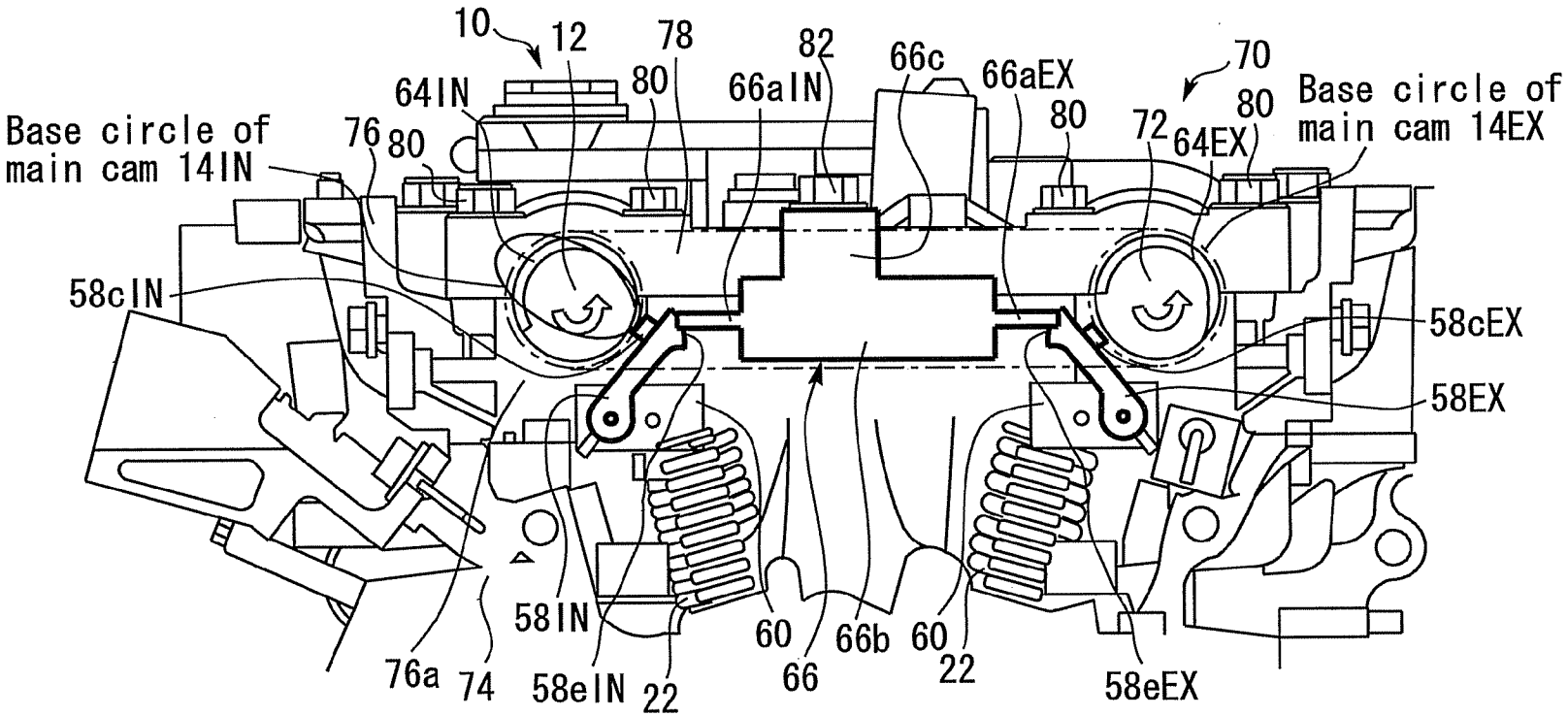
FIG. 12 is a sectional view of the electromagnetic solenoid type actuator seen from the axial direction of the camshaft.

FIG. 12 is a sectional view of the electromagnetic solenoid type actuator 66 seen from the axial direction of the camshaft 12, 72. To be more specific, FIG. 12 is a view of the section of the mounted members of the cylinder head 74 sectioned at the center of the actuator 66 and seen from No. 4 cylinder side.

Note that in FIGS. 11 and 12, for each component of the variable valve operating apparatuses 10 and 70, such as a main cam 14, and an auxiliary cam 16, a symbol "IN" for indicating the intake side, a symbol "EX" for indicating the exhaust side, and a cylinder number "#X" are appropriately attached to the end of the reference numeral of each component respectively to clarify the affiliation thereof.

As shown in FIGS. 11 and 12, the actuator 66 is disposed inside the internal combustion engine 1 (cylinder head 64) in such a way as being interposed between the intake camshaft 12 and the exhaust camshaft 72. To be more specific, the actuator 66 is disposed such that a major part thereof fits in a region encircled by the one-dot chain line shown in FIG. 12. The region encircled by the one-dot chain line herein refers to an oval-shaped region virtually obtained by linking the base circle of the intake-side main cam 14IN and the base circle of the exhaust-side main cam 14EX. Moreover, although the illustration of the actuators 66 other than that for No. 3 cylinder is omitted in FIG. 11, the actuator 66 of each cylinder is disposed so as to oppose each cylindrical part 62 (each guide rail 64). That is, the actuator 66 is disposed so as to fit in the above-described region seen from the axial direction of the camshaft 12, 72, as well as disposed within the length of each camshaft 12, 72 in the axial direction of the camshaft 12, 72.

The actuator 66 includes an actuator body 66*b* which incorporates an electromagnetic solenoid. This actuator body 66*b* includes two movable elements 66*a*IN and 66*a*EX. These movable elements 66*a*IN and 66*a*EX are configured to oppose each other and to be able to protrude toward each guide rail 64IN, 64EX. Moreover, the actuator 66 includes a fixing part 66*c* which is formed integrally with the actuator body 66*b*.

In further addition, the actuator 66 is disposed such that the actuator body 66*b* in its entirety fits in the above-described region as shown in FIG. 12. Moreover, the above-described two movable elements 66*a*IN and 66*a*EX are disposed at a position where the same can protrude from the middle of the above-described region (that is, an intermediate position between the intake camshaft 12 and the exhaust camshaft 72) toward the each guide rail 64IN, 64EX positioned at both ends of the region.

Moreover, each projection part 58*c*IN, 58*c*EX is also disposed at a position where it is abuttable with each movable element 66*a*IN, 66*a*EX via a slide pin 58IN, 58EX in the above-described region, and where it is engageable and disengageable with each guide rail 64IN, 64EX. In other words, each projection part 58*c*IN, 58*c*EX is disposed so as to be interposed between each movable element 66*a*IN, 66*a*EX and each guide rail 64IN, 64EX.

Further, FIG. 12 shows the state in which the movable element 66*a*IN, 66*a*EX is inserted into each notch part 58*e*IN, 58*e*EX, and thereby each projection part 58*c*IN, 58*c*EX is separated from each guide rail 64IN, 64EX. That is, in the present embodiment, each projection part 58*c*IN, 58*c*EX is disposed so as to fit in the above-described region even when separated from each guide rail 64IN, 64EX in this manner.

A cam carrier 76 which includes a lower bearing part 76*a* for supporting the intake camshaft 12 and the exhaust camshaft 72 is assembled onto the cylinder head 74. The lower bearing parts 76*a* are respectively disposed between each cylinder so as to bridge the intake side and the exhaust side. On the lower bearing part 76*a*, there is disposed, a cam cap 78 which functions as an upper bearing part to support the camshaft 12, 72 from the opposite side to the lower bearing part 76*a*. An arrangement is made such that with the camshaft 12, 72 being mounted on the lower bearing part 76*a* of the cam carrier 76, each lower bearing part 76*a* and each cam cap 78 are fastened by use of a fastener bolt 80 to thereby rotatably support the camshaft 12, 72. Moreover, as shown in FIG. 11, the camshaft 12, 27 is supported at its portion proximate to each cylindrical part 62 by each lower bearing part 76*a* and each cam cap 78.

Moreover, in the present embodiment, an arrangement is made such that as shown in FIGS. 11 and 12, the actuator 66 is attached to the cam carrier 76 through the use of the lower bearing part 76*a* for supporting the camshaft 12, 72.

To be more specific, the arrangement is such that as shown in FIG. 11, the fixing part 66*c* of the actuator 66 is put on the cam cap 78 so as to be aligned with the fastening part at the middle of the cam cap 78, and thereafter the fixing part 66*c* is fastened with a fastener bolt 82 to the lower bearing part 76*a* via the cam cap 78, so that the actuator 66 is fixed to the lower bearing part 76*a* of the cam carrier 76 via the cam cap 78. In further addition, the actuator 66 is attached to the lower bearing part 76*a* so as to be along the cam cap 78 and the lower bearing part 76*a*, as shown in FIG. 11.

Figure 13:
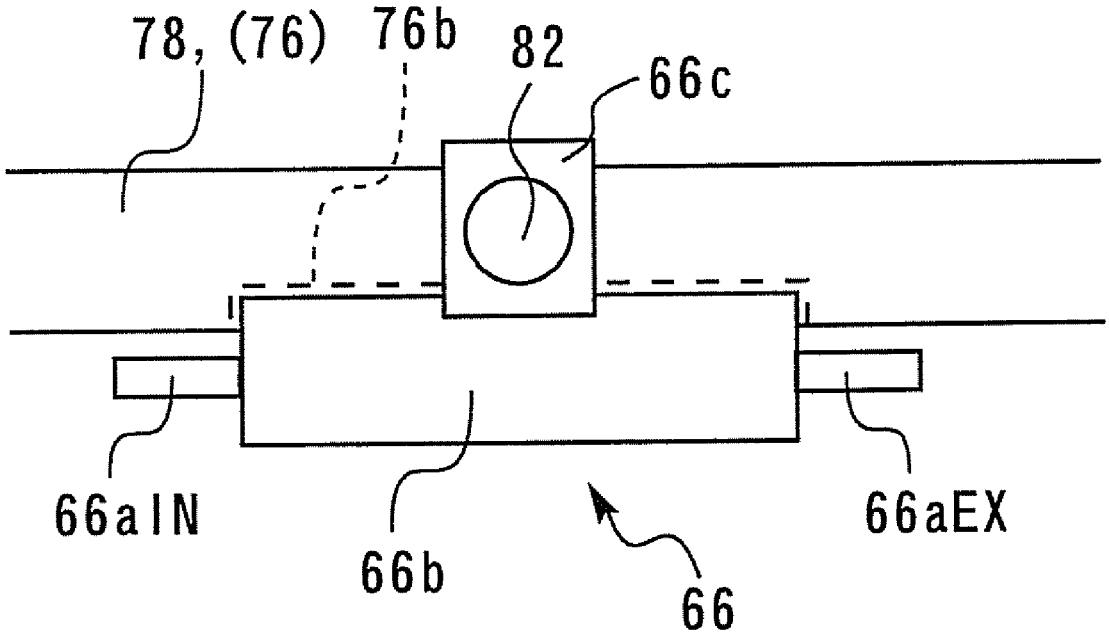
FIG. 13 is a diagram to illustrate details of a positioning method of the actuator by the use of a cam carrier.

FIG. 13 is a diagram to illustrate details of a positioning method of the actuator 66 by the use of the cam carrier 76.

A concave part 76*b* which is formed into a shape along the outer face of the actuator body 66*b* is provided in the portion of the lower bearing part 76*a* of the cam carrier 76 in the periphery of the actuator 66. Moreover, as shown in FIG. 13, the fixing part 66*c* is fastened to the lower bearing part 76*a* with the fastener bolt 82 via the cam cap 78 in a case in which a part of the actuator body 66*b* is fitted into the concave part 76*b*, thereby performing the positioning of the actuator 66 by use of the cam carrier 76. According to such method, it is possible to securely restrict the fixing position of the actuator 66 with respect to the cam carrier 76 (and the cam cap 78) from being deviated due to a repulsive force which acts on the actuator 66 at the time of driving the actuator 66. This makes it possible to ensure accurate operation of the changeover mechanism 24 for performing a valve stopping. Note that a reliable positioning method of the actuator with respect to the cam carrier (and the cam cap) is not limited to the method shown in FIG. 13, and may be one as follows. That is, a convex part which is formed into a shape along the outer shape of the actuator body is provided for the lower bearing part of the cam carrier, so that the positioning of the actuator is performed through the use of the convex part. Alternatively, an arrangement may be such that the actuator is provided with a fixing part which is formed into a sectional C-shape so as to cover the cam carrier and the cam cap from both above and below, so that the actuator is fixed to the cam carrier and the cam cap with a through bolt, which passes through the fixing part, the cam cap, and the cam carrier from one side of the fixing part, and a nut which meshes with the through bolt at the other side of the fixing part.

As so far described, the actuator 66 (actuator body 66*b*) of the present embodiment is disposed, inside the internal combustion engine 1 (cylinder head 74), between the intake camshaft 12 and the exhaust camshaft 72 so as to fit in the above described region represented by the one-dot chain line. In general, it is arranged such that oil is supplied into a cylinder head through the use of an oil shower pipe or the like for the lubrication of a valve operating apparatus. For this reason, according to the actuator 66 of the present embodiment, it becomes possible to effectively cool the actuator 66 with the oil supplied into the cylinder head 74 compared with a case in which an actuator is disposed outside the cylinder head. This makes it possible to suppress overheating of an electromagnetic coil 88 (see FIG. 13) in the actuator 66, thereby favorably preventing the decline of responsiveness of the actuator due to overheating.

Moreover, disposing the actuator 66 (actuator body 66*b*) so as to fit in the above-described region and also disposing the actuator 66 so as to oppose the guide rail 64 makes it possible to dispose the actuator 66 in sufficient proximity to the guide rail 64. This makes it easy to reduce the distance from the movable element 66*a* of the actuator 66 to the contact portion with the guide rail 64 in the projection part 58*c* when the actuator 66 protrudes the projection part 58*c* toward the guide rail 64. As a result of this, the reduction of the distance makes it possible to favorably decrease the stress acting on the actuator 66. Moreover, the reduction of the distance makes it possible to favorably ensure the responsiveness when the actuator 66 drives the projection part 58*c*.

Moreover, the movable elements 66*a*IN and 66*a*EX of the above-described actuator 66 are disposed so as to oppose each other and are positioned so as to be able to protrude from the middle of the above-described region (that is, an intermediate position between the intake camshaft 12 and the exhaust camshaft 72) toward each guide rail 64IN, 64EX positioned at both ends of the region. This makes it possible to perform the engagement and disengagement operations of the projection part 58*c* to the guide rail 64 while sufficiently decreasing the distance from the movable element 66*a*IN, 66*a*EX to the projection part 58*c*. This makes it possible to favorably ensure the responsiveness when the actuator 66 drives the projection part 58*c*. Moreover, as a result of the movable elements 66*a*IN and 66*a*EX being disposed so as to oppose each other, the repulsive driving forces of the two are canceled when the movable elements 66*a*IN and 66*a*EX are driven at the same timing. This makes it possible to effectively suppress the vibration which occurs in the actuator 66 during the driving. Moreover, it becomes possible to accurately operate the changeover mechanism 24 for performing valve stopping.

Moreover, in the present embodiment, each projection part 58*c* is disposed so as to be interposed between each movable element 66*a* and each guide rail 64 in the above-described region even when the projection part 58*c* is separated from each guide rail 64. According to such a configuration, it becomes possible to effectively reduce the distance from the movable element 66*a* to the contact portion with the guide rail 64 in the projection part 58*c* when each movable element 66*a* protrudes the projection part 58*c* toward the guide rail 64. As a result of that, a sufficient reduction of the distance makes it possible to effectively reduce the stress acting on the actuator 66, and also to more sufficiently ensure the responsiveness when the actuator 66 drives the projection part 58*c*.

Moreover, in the present embodiment, the actuator 66 is attached to the cam carrier 76 through the use of a fastening part of the cam cap 78 in a lower bearing part 76*a*. According to such a fixing method of the actuator 66, through the use of the existing members which are provided for supporting the camshafts 12 and 72, it is possible to mount the actuator 66 inside the internal combustion engine 1 at low cost and saving space without providing a new fixing place.

Further, in the present embodiment, the actuator 66 (actuator body 66*b*) is attached to the lower bearing part 76*a* so as to be along the cam cap 78 and the lower bearing part 76*a*. The position of the lower bearing part 76*a* is specified in relation with the camshafts 12 and 72, and the cam cap 78 is positioned with respect to the lower bearing part 76*a*. Because of this, attaching the actuator 66 so as to be along the cam cap 78 and the lower bearing part 76*a* makes it possible to facilitate the positioning between the guide rail 64 provided in the camshaft 12, 72 and the actuator 66.

(Internal Structure of Electromagnetic Solenoid Type Actuator)

Next, an internal structure of the electromagnetic solenoid type actuator 66 will be described with reference to FIGS. 14 and 15.

Figure 14:
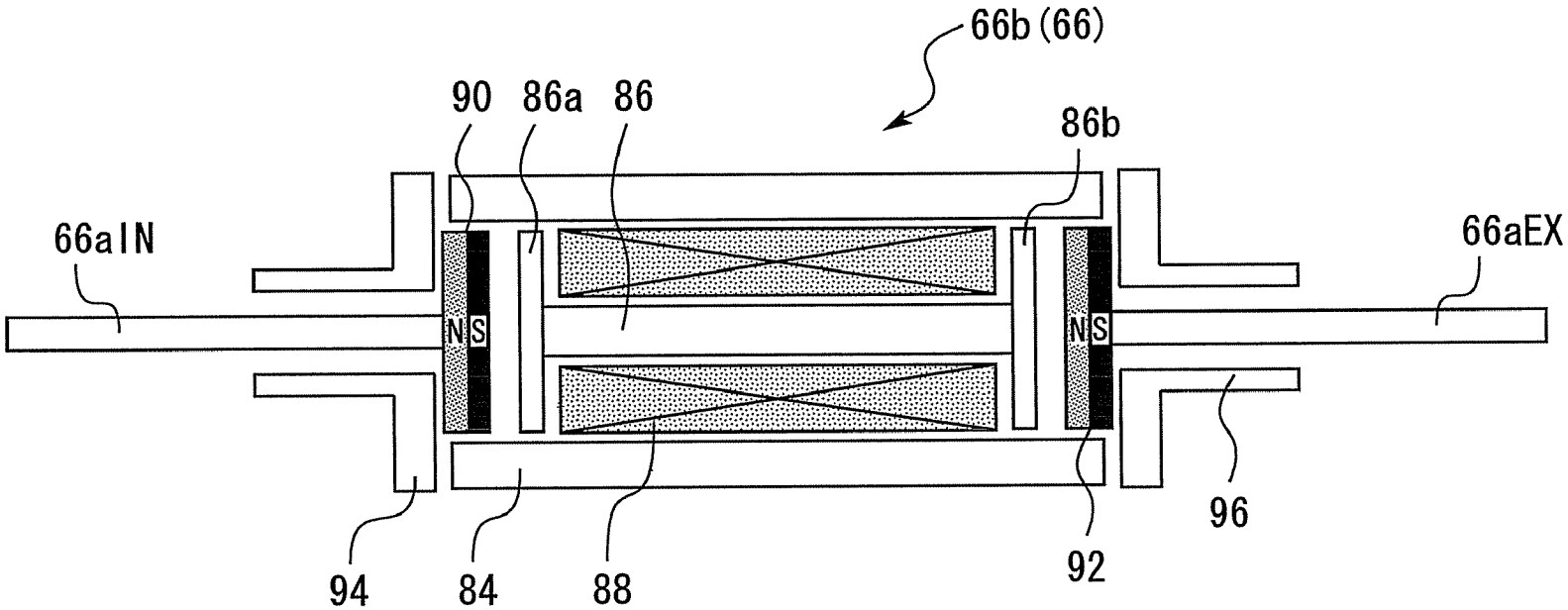
FIG. 14 is a sectional view to illustrate the internal structure of the actuator body of the electromagnetic solenoid type actuator.

FIG. 14 is a sectional view to illustrate the internal structure of the actuator body 66*b* of the electromagnetic solenoid type actuator 66.

As shown in FIG. 14, the actuator body 66*b* includes a stator 84. An inner fixed iron core 86 which is made up of a magnetic material is disposed inside the stator 84. Moreover, an electromagnetic coil 88 is provided around the perimeter of the inner fixed iron core 86 inside the stator 84.

Both end parts 86*a* and 86*b* of the inner fixed iron core 86 are formed into a disc shape. Moreover, the actuator body 66*b* is provided with a pair of permanent magnets 90 and 92 in such a manner to oppose the respective end parts 86*a* and 86*b*. One permanent magnet 90 (on the left in FIG. 14) is fixed to the intake side movable element 66*a* in the opposite surface to the surface opposed to the above-described end part 86*a*, and the remaining permanent magnet 92 (on the right in FIG. 14) is fixed to the exhaust side movable element 66*a* in the opposite surface to the surface opposed to the above-described end part 86*b*. To be more specific, the above-described permanent magnet 90 is configured such that the surface to be fixed to the movable element 66*a* serves as an N-pole and the surface opposed to the above-described end part 86*a* serves as an S-pole. Moreover, the above-described permanent magnet 92 is configured such that the surface opposed to the above-described end part 86*b* serves as an S-pole, and the surface to be fixed to the movable element 66*a* serves as an S-pole.

Further, the actuator body 66*b* includes, outside the permanent magnet 90, an outer fixed iron core 94 having a surface opposed to the surface of the N-pole side in the permanent magnet 90 and also includes, outside the permanent magnet 92, an outer fixed iron core 96 having a surface opposed to the surface of the S-pole side in the permanent magnet 92. Note that an arrangement is made such that the attractive force generated between the outer fixed iron core 94, 96 and the permanent magnet 90, 92 is larger than the attractive force generated between the inner fixed iron core 86 and the permanent magnet 90, 92 during energization.

Figure 15:
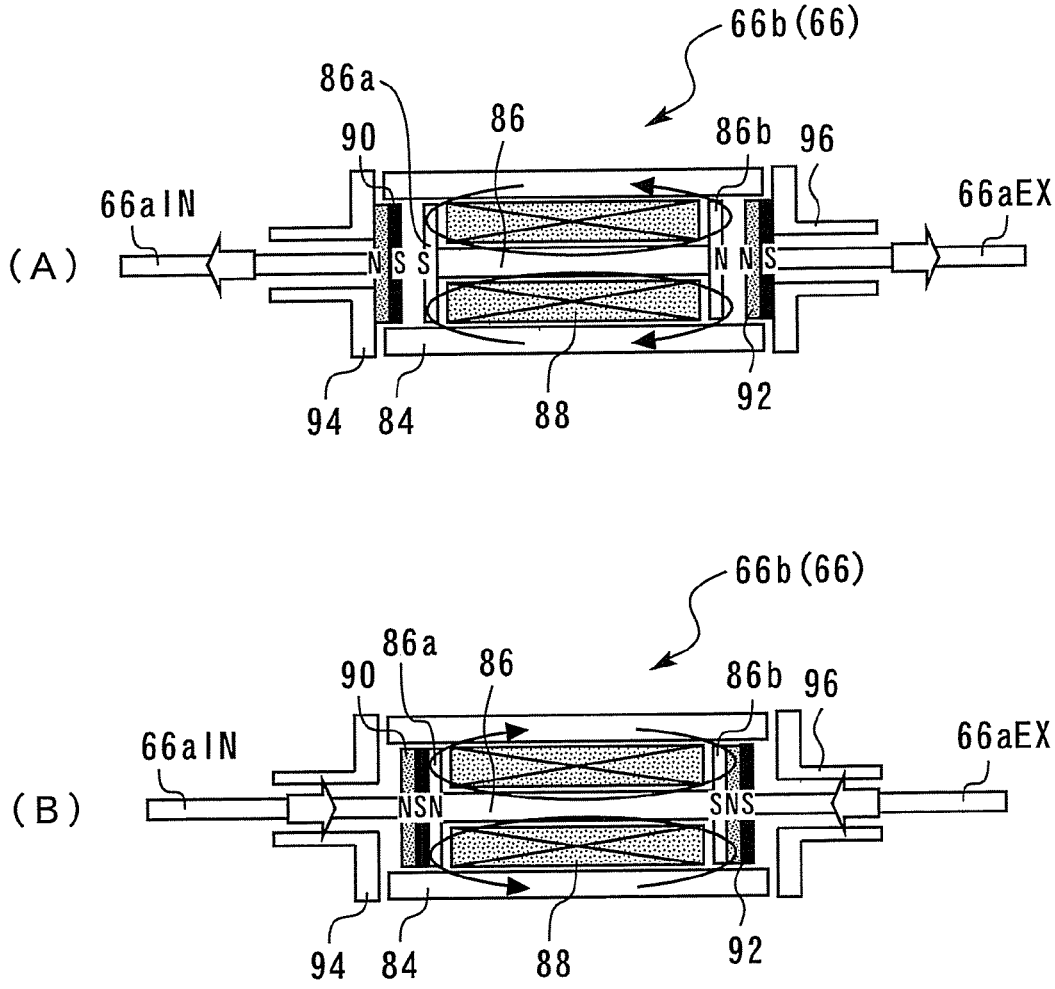
FIG. 15 is a diagram illustrating the operation of the actuator shown in FIG. 14.

FIG. 15 is a diagram illustrating the operation of the actuator 66 shown in FIG. 14.

As described so far, the actuator 66 is adapted to drive the left and right movable elements 66*a*IN and 66*a*EX, to which the permanent magnets 90 and 92 are respectively attached, by means of the single electromagnetic coil 88 that is the centrally disposed.

FIG. 15(A) shows a case in which an excitation current is supplied to the electromagnetic coil 88 such that the left-side end part 86*a* of the inner fixed iron core 86 serves as an S-pole and the right-side end part 86*b* serves as an N-pole. In this case, as shown in FIG. 15(A), a repulsive force is generated respectively between the magnetic poles formed in the inner fixed iron core 86 and the magnetic poles of the left and right permanent magnets 90 and 92. Therefore, when the excitation current in the direction as shown in FIG. 15(A) is supplied to the permanent magnets 90 and 92 which are in mutual attraction with the inner fixed iron core 86, the left and right movable elements 66*a*IN and 66*a*EX are respectively protruded outwardly.

On the other hand, FIG. 15(B) shows a case in which an excitation current in the direction opposite to that in above-described FIG. 15(A) is supplied to the electromagnetic coil 88 such that the left-side end part 86*a* of the inner fixed iron core 86 serves as an N-pole and the right-side end part 86*b* serves as an S-pole. In this case, as shown in FIG. 15(B), an attractive force is generated respectively between the magnetic poles formed in the inner fixed iron core 86 and the magnetic poles of the left and right permanent magnets 90 and 92. Therefore, when the excitation current in the direction as shown in FIG. 15(B) is supplied to the permanent magnets 90 and 92 which are in mutual repulsion with the outer fixed iron cores 94 and 96, the left and right movable elements 66*a*IN and 66*a*EX are respectively returned inwardly.

According to the actuator 66 configured as described above, it is possible to concurrently drive both of the movable elements 66*a*IN and 66*a*EX of the intake side and the exhaust side by the ECU 26 giving a command of a predetermined excitation current to the single electromagnetic coil 88. This makes it possible to reduce the number and size of the actuators 66, and also to provide for cost reduction in hardware by the reduction of the number and size of the actuator 66, as well as the cost reduction of the control system of the actuator 66 (such as the reduction of the number of control ports). Further, according to an actuator which can concurrently operate in two directions like this actuator 66, it is possible to cancel the repulsive driving forces of the two movable elements. This makes it possible to effectively suppress the vibration which occurs in the actuator during driving.

Moreover, according to the above-described actuator 66, in a state in which the permanent magnets 90 and 92 are protruded up to a position to come into contact with the outer fixed iron cores 94 and 96 (the valve stop state), the position of the movable element 66*a* is held by the attractive force generated between the outer fixed iron core 94, 96 and the permanent magnet 90, 92. Furthermore, in a state in which the permanent magnets 90 and 92 are returned up to a position to comes into contact with the inner fixed iron core 86 (the valve operable state), the position of the movable element 66*a* is held by the attractive force between the inner fixed iron core 86 and the permanent magnets 90 and 92. Thus, according to the configuration of the above-described actuator 66, it is possible to obviate the need of electric power for holding each of these states.

Meanwhile, in the first embodiment, which has been described above, description is made taking a configuration as an example in which the valve-opening characteristics of the valve 18 is changed from the valve operable state to the valve stop state as the slide pin 58 to which the projection part 58*c* is fixed is relatively displaced with respect to the cylindrical part 62 by which the axial position of the camshaft 17, 72 is restricted, when the projection part 58*c* protruded by the actuator 66 and the guide rail 64 are in engagement with each other. However, the variable valve operating apparatus to be addressed in the present invention is not limited to such a configuration, and it may be, for example, a variable valve operating apparatus having the configuration as follows. That is, an actuator including a movable element which functions as the projection part of the present invention is provided. Further, a member that includes a cylindrical part to which the guide rail is fixed, and two types of cams are attached to the camshaft so as to be movable in the axial direction. Then, an arrangement is made such that the valve-opening characteristics of a valve is changed as the above-described member which includes the cylindrical part and two types of cams is relatively displaced with respect to the actuator (projection part) by which the axial position of the camshaft is restricted, when the projection part and the guide rail are in engagement with each other.

Moreover, although in the first embodiment, which has been described above, description is made on a configuration in which a variable valve operating apparatus is provided for both the intake valve and the exhaust valve, the variable valve-operating apparatus in the present invention may be one provided for at least one of the intake valve and the exhaust valve.

Further, in Embodiment 1 described above, the arrangement is such that two movable elements 66*a*IN and 66*a*EX and a single electromagnetic coil 88 are provided, and the valve-opening characteristics of the intake valve 18 and the exhaust valve, which are respectively driven by the two camshafts 12 and 72, are changed by the single actuator 66. However, the actuator in the present invention is not limited to such a configuration, and may be two actuators separately provided for each of the first and second camshafts. Further, even when actuators are separately provided for each camshaft, by disposing two movable elements to be opposed to each other as in the first embodiment described above, the repulsive driving forces of the two can be canceled when these movable elements are driven at the same timing.

Because of this, in this case as well, it is possible to effectively suppress the vibration which occurs in the actuator during driving.

Furthermore, in the first embodiment, which has been described above, description is made taking a configuration as an example in which a major part of the actuator 66, in other words, the entirety of the actuator body 66*b*, fits in the above-described region shown in FIG. 12. However, the actuator of the present invention may be any kind, provided that at least a part of it is disposed in the above-described region.

Furthermore, in the present embodiment, which has been described above, description is made taking a configuration as an example in which a dedicated intake camshaft 12 for driving the intake valve 18 and a dedicated exhaust camshaft 72 for driving the exhaust valve are provided. However, the first camshaft and the second camshaft in the present invention are not limited to such a configuration, a configuration may be such that for example, a first camshaft is responsible for driving one intake valve and one exhaust valve in the same cylinder, and a second camshaft is responsible for driving another intake valve and another exhaust valve in the same cylinder.

Further, in the first embodiment, which has been described above, the arrangement is made such that since the base circle diameters of the main cams 14IN and 14EX are larger than the circle diameters of the cylindrical parts 62IN and 62EX, the mounting position of the actuator 66 is defined in association with an oval-shaped region virtually obtained by linking the base circle of the intake-side main cam 14IN and the base circle of the exhaust-side main cam 14EX. However, the oval-shaped region which is used to identify the mounting position of the actuator in the present invention is not limited to the one as specified in this way. That is, in the present invention, if a configuration is provided in which the circle diameter of the cylindrical part is larger than the base circle of the cam, the above-described region is specified by using the circle of the cylindrical part.

Further, in the first embodiment, which has been described above, although description is made on an example in which the auxiliary cam 16 is configured as a zero lift cam, the auxiliary cam of the present invention is not limited to a zero lift cam. That is, it may be a cam having a nose part which enables obtaining a smaller lift than that of the main cam 14.

Note that in the first embodiment, which has been described above, the intake valve 18 corresponds to the "first valve" according to the first aspect of the present invention; the main cam 14IN corresponds to the "first cam" according to the first aspect of the present invention; the intake camshaft 12 corresponds to the "first camshaft" according to the first aspect of the present invention; the exhaust valve (not shown) included in the exhaust variable valve operating apparatus 70 corresponds to the "second valve" according to the first aspect of the present invention; the main cam 14EX corresponds to the "second cam" according to the first aspect of the present invention; and the exhaust camshaft 72 to the "second camshaft" according to the first aspect of the present invention.

Moreover, in the first embodiment, which has been described above, the range specified by the displacement end Pmax1 and the displacement end Pmax2 corresponds to the "reciprocating range" according to the second aspect of the present invention, and the slide pin 58 corresponds to the "displacement member" according to the second aspect of the present invention.

Further, in the first embodiment, which has been described above, the movable element 66*a*IN and the movable element 66*a*EX correspond to the "first movable element" and the "second movable element" according to the fourth or seventh aspect of the present invention.

Further, in the first embodiment, which has been described above, the cam carrier 76 corresponds to the "camshaft support member" according to the ninth aspect of the present invention.

Further, the cam cap 78 corresponds to the "upper bearing part" according to the tenth aspect of the present invention.

Second Embodiment

Next, a second embodiment of the present invention will be described with reference to FIG. 16.

It is supposed that the configurations of variable valve operating apparatuses 100 and 120 of the present embodiment are the same as those of the variable valve operating apparatuses 10 and 70 of the first embodiment described above excepting that there are differences in the configurations relating to an electromagnetic solenoid type actuator 102.

Figure 16:
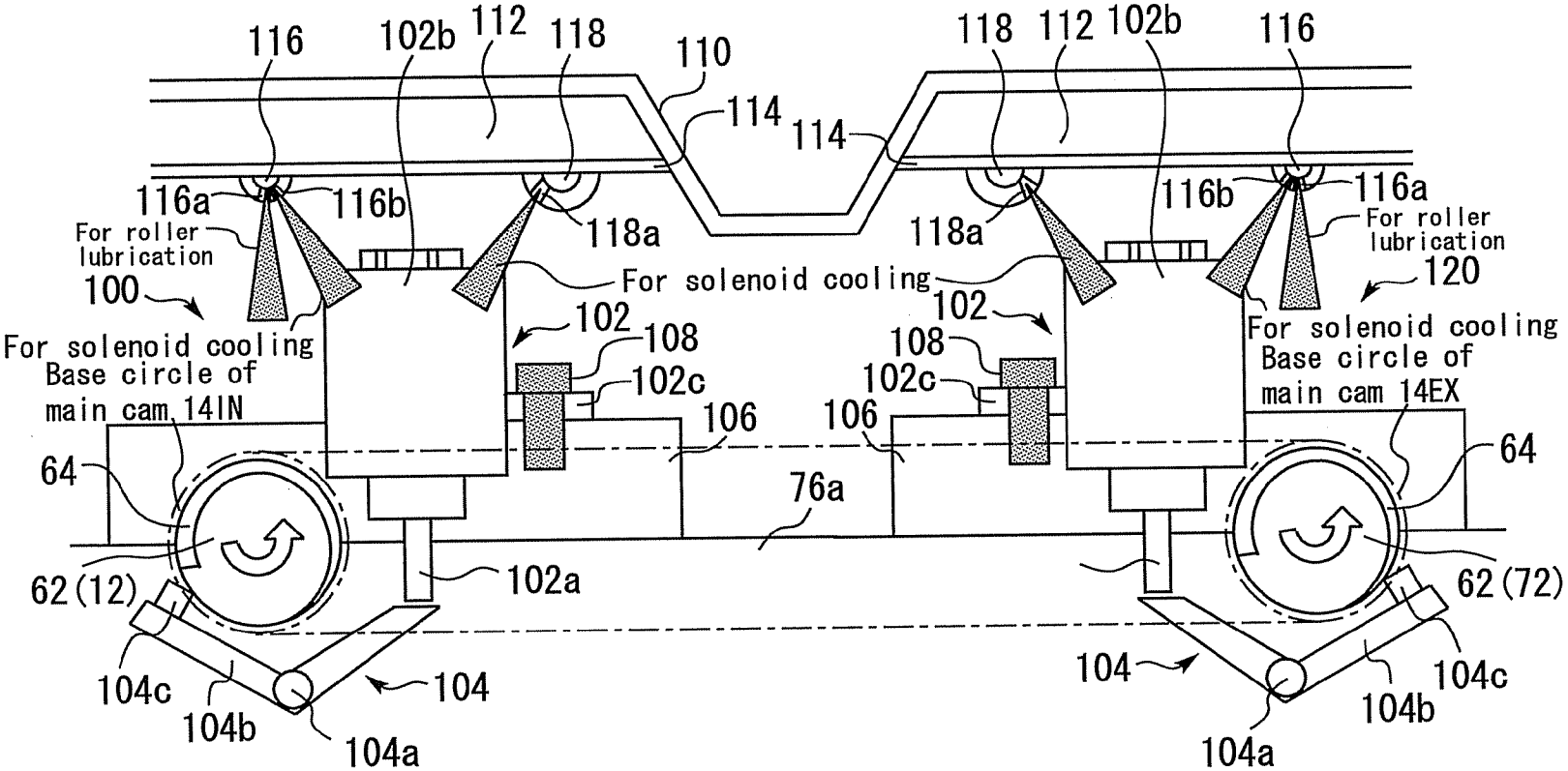
FIG. 16 is a diagram for illustrating a detailed configuration of an electromagnetic solenoid type actuator according to the second embodiment of the present invention.

FIG. 16 is a diagram for illustrating a detailed configuration of the electromagnetic solenoid type actuator 102 according to the second embodiment of the present invention. Note that in FIG. 16, the same element as that shown in above-described FIG. 12 is given the same reference character thereby omitting or simplifying the description thereof. Moreover, since the exhaust variable valve operating apparatus 120 is basically configured in the same manner as the intake variable valve operating apparatus 100, the detailed description thereof is herein be omitted.

The configuration shown in FIG. 16 includes a slide pin 104 which includes an arm part 104*b* formed into an L-shape and is configured to be movable in the axial direction and rotatable around the axial center of a circular column part 104*a*. The electromagnetic solenoid type actuator 102 is configured such that a projection part 104*c* fixed to the slide pin 104 can be made to engage with the guide rail 64 by giving a thrust of a movable element 102*a* to such slide pin 104.

Further, in the present embodiment as well, a part of the actuator 102 is disposed so as to fit in a region shown in FIG. 16 which is defined in the same way as the above described region shown in above-described FIG. 12. The actuator 102 is fixed to a cam cap 106 with a fastener bolt 108 via its fixing part 102*c*.

Further, the actuator 102 is disposed on a head cover 110 side with respect to the lower bearing part 76*a*, and more specifically, is disposed such that an end part (lower end) of the actuator body 102*b* is lower than the upper surface of the cam cap 106. According to such a configuration, it becomes possible to suppress the mounting position of the actuator 102 to be low. This makes it easy to avoid an interference with other components disposed on the head cover 110. Moreover, this makes it easy to avoid a decrease in the volume of a PCV (positive crankcase ventilation) chamber 112 which is provided to separate the blow-by gas from oil which are present inside the head cover 110.

Further, as shown in FIG. 16, a baffle plate 114 is provided in the back side of the head cover 110. The actuator 102 is disposed in a space lower than the baffle plate 114 as a result of the mounting position being suppressed to be low by the above-described fixing method.

There is provided in the baffle plate 114, an oil shower pipe 116 which includes an injection hole 116*a* for injecting oil toward each roller member (for example, a first roller 36) included in the intake variable valve operating apparatus 100. Moreover, there is also provided in the oil shower pipe 116, an injection hole 116*b* for injecting oil toward each actuator body 102*b*. In other words, the actuator 102 is disposed in the direction of oil injection by the injection hole 116*b* of the oil shower pipe 116.

Further, there is provided in the baffle plate 114, a fresh air passage 118 for passing fresh air into the inside of the head cover 110 for the processing of the blow-by gas. The fresh air passage 118 is formed with the opening part 118*a* for impinging fresh air on each actuator body 102*b*. In other words, the actuator 102 is disposed in the vicinity of an opening part 118*a* of the fresh air passage 118 inside the head cover 110.

According to the configuration of the present embodiment described so far, oil injected from the oil shower pipe 116 impinges on the actuator body 102*b*, thereby making it possible to effectively cool the actuator body 102*b* which incorporates an electromagnetic coil. Further, fresh air supplied from the fresh air passage 118 impinges directly on the actuator body 102*b*, thereby making it possible to effectively cool the actuator body 102*b*. This makes it possible to stabilize the temperature of the actuator 102, thereby improving the robustness of response of the actuator 102.

Note that in the second embodiment, which has been described above, the cam carrier 76 corresponds to the "camshaft support member" according to the eleventh aspect of the present invention.

Further, in the second embodiment, which has been described above, the oil shower pipe 116 corresponds to the "oil injection member" according to the twelfth aspect of the present invention.

The invention claimed is:

1. A variable valve operating apparatus for an internal combustion engine, comprising:

a first camshaft to which a first cam for driving a first valve in a cylinder of the internal combustion engine is attached fixedly or movably in an axial direction;

a second camshaft to which a second cam for driving a second valve disposed in the same cylinder as that of the first valve is attached fixedly or movably in an axial direction;

a guide rail which is provided in an outer peripheral surface of a cylindrical part which is attached fixedly or movably in the axial direction respectively to the first and second camshafts;

a projection part which is disposed so as to be engageable and disengageable with the guide rail; and an actuator which is disposed so as to oppose the cylindrical part, and is able to protrude the projection part toward the guide rail, wherein valve-opening characteristics of the first valve and the second valve are changed as a relative displacement between the projection part and the cylindrical part takes place at a time of engagement between the projection part and the guide rail, and wherein in a state in which the projection part is not protruded toward the guide rail, at least a part of the actuator is disposed so as to fit in an oval-shaped region seen from the axial direction of the first and second camshafts, the oval-shaped region being virtually obtained by linking: a circle of the larger of a circle diameter of the cylindrical part and a base circle diameter of the first cam which are attached to the first camshaft; and a circle of the larger of a circle diameter of the cylindrical part and a base circle diameter of the second cam which are attached to the second cam.

2. The variable valve operating apparatus for the internal combustion engine according to claim 1, further comprising:

a variable mechanism disposed at least in one of between the first cam and the first valve, and between the second cam and the second valve, the variable mechanism adapted to change the valve-opening characteristics of at least one of the first valve and the second valve; and a displacement member adapted to move within a predetermined reciprocating range thereby switching between operational states of the variable mechanism, wherein the projection part is fixed to the displacement member.

3. The variable valve operating apparatus for the internal combustion engine according to claim 1, wherein the projection part is disposed so as to fit in the oval-shaped region seen from the axial direction of the first and second camshafts in a state in which the projection part is not protruded toward the guide rail.

4. The variable valve operating apparatus for the internal combustion engine according to claim 1, wherein the actuator includes: a first movable element which is disposed, within the oval-shaped region, at a position where the first movable element is capable of protruding toward the cylindrical part attached to the first camshaft; and a second movable element which is disposed, within the oval-shaped region, at a position where the second movable element is capable of protruding toward the cylindrical part attached to the second camshaft.

5. The variable valve operating apparatus for the internal combustion engine according to claim 4, wherein the first movable element and the second movable element are disposed to oppose each other and are disposed at a position where the first movable element and the second movable element are capable of protruding respectively toward the corresponding cylindrical part.

6. The variable valve operating apparatus for the internal combustion engine according to claim 4, wherein the actuator is an electromagnetic solenoid type actuator, and includes a single electromagnetic coil which drives the first movable element and the second movable element.

7. The variable valve operating apparatus for the internal combustion engine according to claim 3, wherein the actuator includes: a first movable element which is disposed, within the oval-shaped region, at a position where the first movable element is capable of protruding toward the cylindrical part attached to the first camshaft; and a second movable element which is disposed, within the oval-shaped region, at a position where the second movable element is capable of protruding toward the cylindrical part attached to the second camshaft, and wherein the projection part is respectively interposed between the guide rail attached to the first camshaft and the first movable element, and between the guide rail attached to the second camshaft and the second movable element.

8. The variable valve operating apparatus for the internal combustion engine according to claim 7, wherein the actuator is an electromagnetic solenoid type actuator, and includes a single electromagnetic coil which drives the first movable element and the second movable element.

9. The variable valve operating apparatus for the internal combustion engine according to claim 1, further comprising:

a camshaft support member including a lower bearing part which supports the first and the second camshafts from a cylinder head side of the internal combustion engine, wherein the actuator is attached to the lower bearing part.

10. The variable valve operating apparatus for the internal combustion engine according to claim 9, wherein the cylindrical part is disposed in proximity to the lower bearing part, and wherein the actuator is attached to the lower bearing part so as to be along at least one of: an upper bearing part which supports the first and second camshafts from an opposite side of the lower bearing part; and the lower bearing part.

11. The variable valve operating apparatus for the internal combustion engine according to claim 1, further comprising:

a camshaft support member including a lower bearing part which supports the first and second camshafts from a cylinder head side of the internal combustion engine; and a head cover which covers the camshaft support member from an opposite side of the cylinder head, wherein the actuator is disposed in the head cover side with respect to the lower bearing part.

12. The variable valve operating apparatus for the internal combustion engine according to claim 11, further comprising:

an oil injection member which is disposed inside the head cover and injects oil into an inside of the head cover, wherein the actuator is disposed in a direction of the oil injection by the oil injection member.

13. The variable valve operating apparatus for the internal combustion engine according to claim 11, further comprising:

a fresh air passage which is disposed inside the head cover and makes fresh air flow into the inside of the head cover for processing of blow-by gas, wherein the actuator is disposed in a vicinity of an opening part of the fresh air passage inside the head cover.

* * * * *